US005474376A

United States Patent [19]

Saunders

[11] Patent Number: 5,474,376

[45] Date of Patent: Dec. 12, 1995

[54] SUPPORT LINKAGE APPARATUS ASSEMBLY

[76] Inventor: Donald W. Saunders, 1462 Cedar Run Rd., Blacksburg, Va. 24060

[21] Appl. No.: 170,443

[22] Filed: Dec. 20, 1993

Related U.S. Application Data

[62] Division of Ser. No. 848,724, Mar. 9, 1992, abandoned.

[51] Int. Cl.[6] ..... A47B 88/00

[52] U.S. Cl. ..... 312/322; 74/103

[58] Field of Search ..... 312/24, 27, 322, 312/328, 334.2; 74/96, 103; 248/281.1

[56] References Cited

U.S. PATENT DOCUMENTS

| | | | |
|---|---|---|---|
| 345,986 | 7/1886 | Olds . | |
| 470,037 | 3/1892 | Cary . | |
| 559,330 | 4/1896 | Hill . | |
| 1,307,261 | 6/1919 | Lee | 312/27 |
| 1,633,461 | 6/1927 | Sopher | 312/322 |
| 2,522,467 | 9/1950 | Shea | 312/27 |
| 2,749,202 | 6/1956 | Ritzerfeld et al. | 312/322 |
| 2,973,869 | 3/1961 | Raymond . | |
| 3,524,692 | 8/1970 | Preston | 312/322 |
| 4,314,734 | 2/1982 | Grunert . | |
| 4,317,383 | 3/1982 | Kurosaki | 74/110 |
| 4,343,244 | 8/1982 | Moriarty . | |
| 4,567,782 | 2/1986 | Speicher | 74/96 |

*Primary Examiner*—Kenneth J. Dorner
*Assistant Examiner*—Gerald A. Anderson

[57] ABSTRACT

A support linkage apparatus assembly provides a balanced extension and retraction of supported elements with useful inclination. The supported element comprises the coupler link element mass and is prepositioned between parallel linkage apparatuses. The support linkage apparatus assembly provides prepositioned support of elective elements. A display rack assembly provides storage and display of paper and materials of negligable mass. A drawer assembly provides cradled storage and a balanced opening and closing inclination of various supplies of three dimensional mass. A container assembly provides a balanced opening and closing inclination of various supplies of three dimensional mass.

10 Claims, 11 Drawing Sheets

FIG. 4A
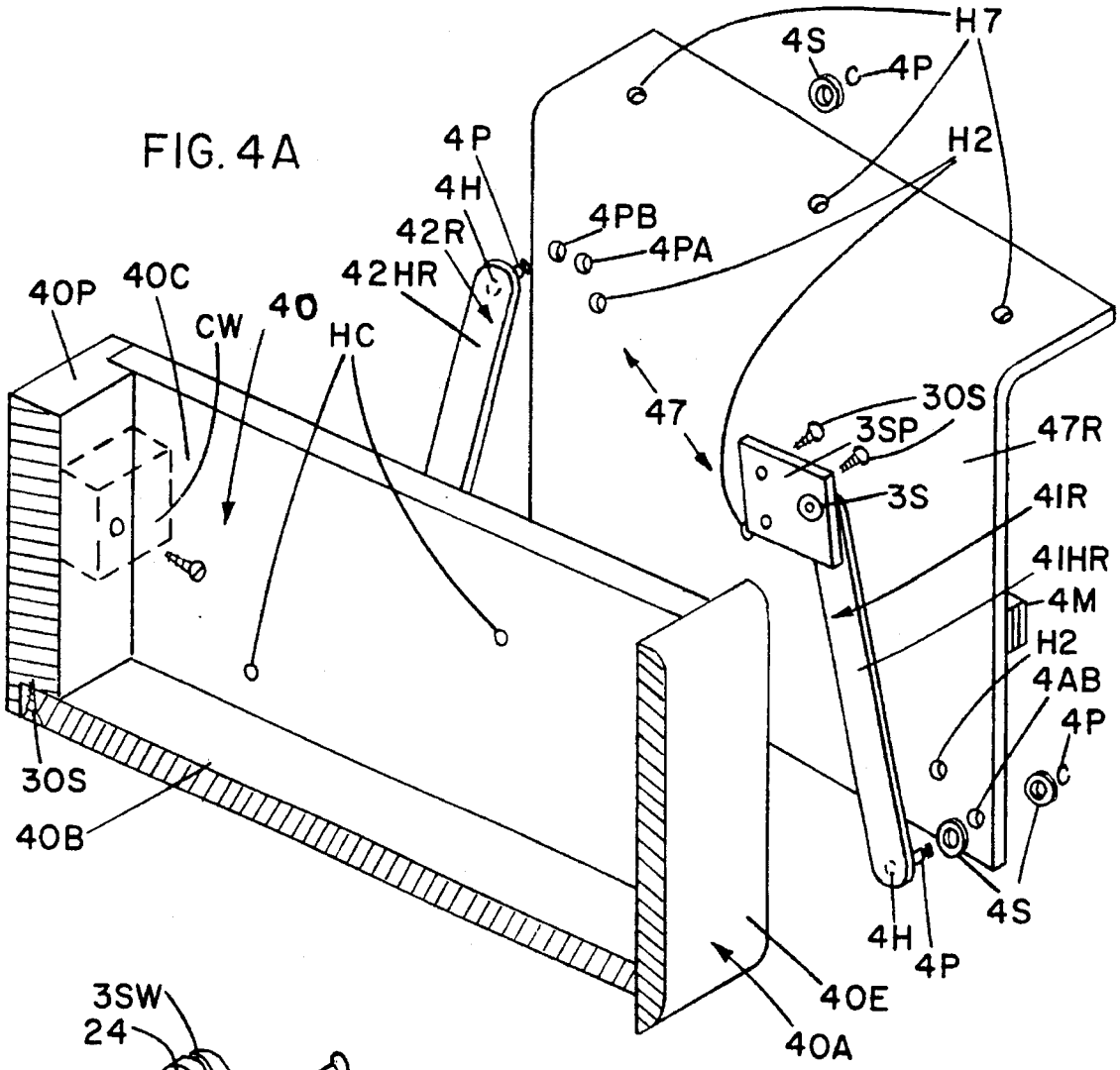
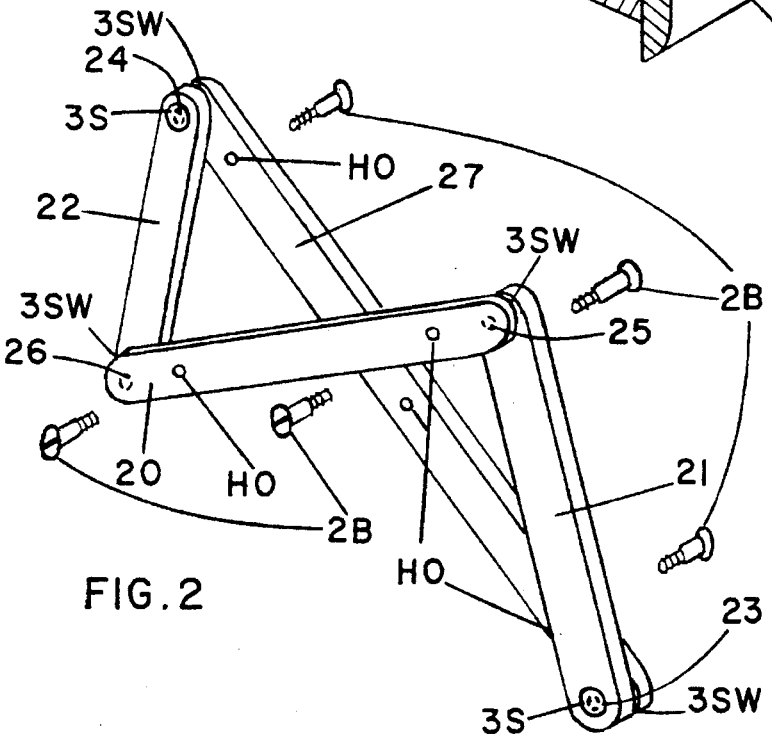
FIG. 2

SUPPORT LINKAGE APPARATUS ASSEMBLY

This application is a division of Ser. No. 848,724 filed Mar. 9, 1992 now abandoned.

BACKGROUND—FIELD OF INVENTION

This invention relates to movable support assemblies which provide for the extension and retraction of storage elements between open and closed positions. More particularly this invention relates to improved and balanced support assemblies which provide for the opening and closing inclinations of counterpoised storage elements.

1. Background—Description of Prior Art

In the prior art various slides, rollers, and complex linkage assemblies support storage shelves, drawers and container elements. A problem which this invention seeks to overcome is best explained in connection with drawer support assemblies although it is to be understood that this invention has many other and different support applications. In existing drawer assemblies accessability and visibility within the drawer requires extension of the drawer beyond the anterior frame supports. Extended drawer positions produce cantilevered moment forces distributed between the anterior and posterior bearings in opposing directions. Positioning the drawer over the anterior supports balances the drawer center of mass over the anterior support frame, partially opened. Closed drawer positions produce vertical loads in the same direction distributed between the anterior and posterior bearings. Drawer movement between extended, balanced and closed drawer positions present complex problems with the changing bearing requirements.

Drawer bearing forces in various drawer positions present problems of unknown ergonomic force requirements needed for movement. The drawer distributes varied loads between opposite sides of the drawer support assembly. Drawer movement between parallel supporting assemblies requires forces which enguage motion on opposing sides simultaneously. Principle motion may occur independently along one side in response to unevenly distributed loads and forces. Jamming from unevenly distributed loads and operator forces produces a problem with predicting the ergonomic forces required for controlling parallel movement.

Various complex display rack support assemblies provide for tilted drawer positions. Movement between tilted and horizontal positions requires operator support of the extended portion of the drawer. The control of jamming restrictions is divided between the operator and the plural posterior drawer supports. The parallel ergonomic requirements of tilting manipulations present ergonomic problems detering the populus use of tiltable assemblies.

In the prior art, a Watt's type double lever four bar linkage provides prior art formula assisting in the technical application of the invention.

2. Objects and Advantages

There is provided, in accordance with the present invention, restrained inclination of supported elements between open and closed positions provided by parallel proportional four bar linkage supports. It is the general object of this invention to provide a joint solution to the support of drawers and tiltable assemblies without complex ergonomic problems. The proportional linkages balance the supporting movement through opening and closing inclinations by counterpoising the weight of the drawer within the linkages motion.

A objective feature demonstrated by this invention envolves to use of gravitational forces acting on storage elements weight or mass. Storage element inclination provides storage exposure without cantilever of the drawer center mass beyond the anterior supports.

Advantages of this invention generally follow the united features of parallel proportional support linkages. Providing drawer support through pivotal linkage bearing supports provides a simple bearing relationship with the frame. A simple pivotal support assembly enables a consistant range of motion and ease of repeated storage. Restrained drawer inclinations employ the rotational drawer mass and reduces the independent motion and jamming restrictions as compared with existing assemblies.

A advantage demonstrated by the invention disclosure provides substantially interchangable components promoting varied applications. Other objects and advantages of the invention will be apparent from the following description and use by construction.

BRIEF DESCRIPTION OF THE DRAWINGS

In the drawings, closely related figures compose the same number followed by R, right, and L, left, suffixes are deleted for brevity sake in some instances.

FIG. 4A is a fragmented sectional view taken along 7—7 with the drawer retracted to a closed position in FIG. 3.

REFERENCE NUMERALS IN THE DRAWINGS

Figure 1A:
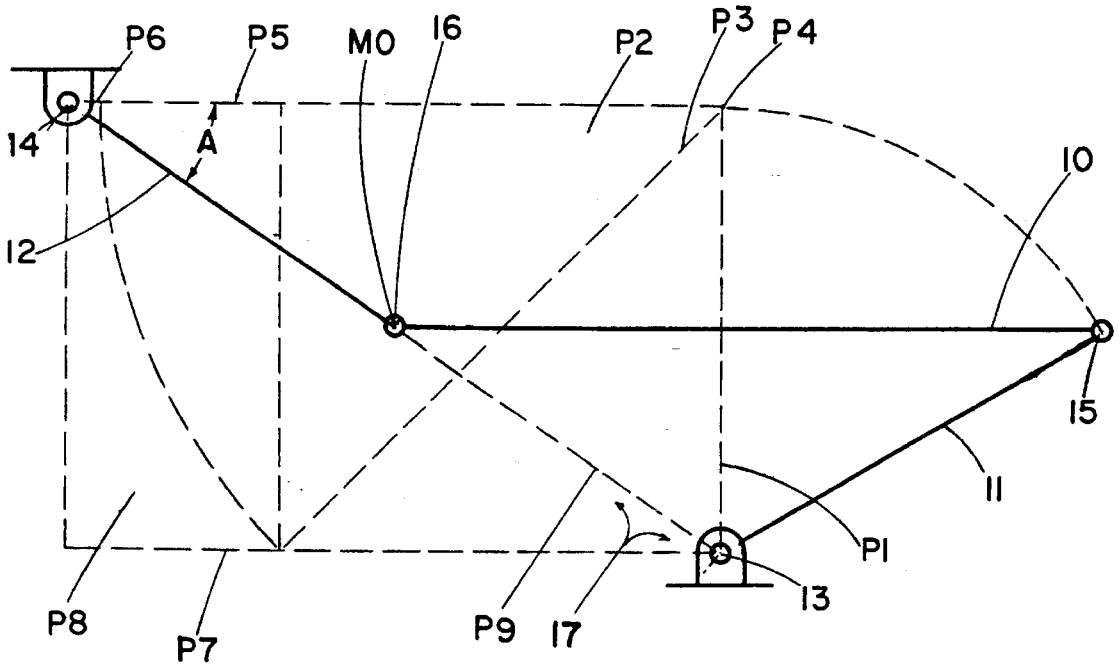
FIG. 1A is a kinematic view of geometric constructions of the proportional linkage in a initial dead center position.

P1 Basic vertical dimension of geometric constructions
P2 Square of basic vertical dimension
P3 Diagonal dimension of P2
P4 Upper end point of P1
P5 Basic minimal horizontal span between the fixed pivots
P6 Graphically illustrated extension of P5
P7 Basic horizontal span between the fixed pivots
P8 Basic rectangle constructed with P1 and P7
P9 Diagonal dimension of basic rectangle P8
10 Coupler link of proportional linkage
11 Anterior link of proportional linkage
12 Posterior link of proportional linkage
13 Anterior lower fixed pivot
14 Posterior upper fixed pivot
15 anterior-coupler link pivot
16 posterior-coupler link pivot
17 Fixed link of proportional linkage
M0 Midpoint between the fixed pivots
M1 Initial center of mass position based on vertical anterior link 11 assembly position
C1 Center of mass position based on vertical anterior link position
M2, C2 Center of mass position based on a vertical poised assembly transfer position
M3, C3 Center of mass position based on 45 degree position of posterior link 12
M4, C4 Center of mass position based on the posterior-fixed link dead center position
M5, C5 Center of mass position based on vertical posterior link 12 assembly position
M6 Center of mass position based on a cradled assembly position
C6 Center of mass position corresponding with the initial M6 assembly position
C9 Coupler curve of initial midpoint center of mass transmission
I1, D1 Linkage instant center corresponding with M1, C1
I2, D2 Linkage instant center corresponding with M2, C2
I3, D3 Linkage instant center corresponding with M3, C3
I4, D4 Linkage instant center corresponding with M4, C4
I5, D5 Linkage instant center corresponding with M5, C5
I6, D6 Linkage instant center corresponding with M6, C6
A1, B1 Alignments of I1-M1, D1-C1
A2, B2 Alignments of I2-M2, D2-C2
A3, B3 Alignments of I3-M3, D3-C3
A4, B4 Alignments of I4-M4, D4-C4
A5, B5 Alignments of I5-M5, D5-C5
A6, B6 Alignments of I6-M6, D6-C6
20 Coupler linkage element
21 Anterior linkage element
22 Posterior linkage element
23 Anterior-fixed linkage pin
24 Posterior-fixed linkage pin
25 Anterior-coupler linkage pin
26 Posterior-coupler linkage pin
27 Fixed linkage element
2B Fastening bolt
H0 Linkage threaded fastening hole
30A Storage and display rack assembly
30 Coupler link shelf element
30D Alternate coupler link shelf element
30B Shelf element base
30BA Posterior inclined shelf element base
30CR Contoured right side panel
30E Anterior end panel
30EA Alternate anterior end panel
30F Display rack frame
30H Horizontal standard
30S Fastening screw
30P Posterior end panel
30PA Alternate posterior end panel
30M Anterior moulding
30X Lateral stabilizer
31HR Right pivotal column
31R Right anterior column assembly
31L Left anterior column assembly
32HR Right pivotal hanger
32R Right posterior hanger assembly
32L Left posterior hanger assembly
37 Inclined fixed link dimension
3AB Column pivotal bearing hole
3AW Pin Welding hole
3B Pin bearing hole
3C Indent from opposing side detent in posterior hanger
3D Indent in support plate 3SP
3EP Anterior support plate
3P Shoulder pin
3S Shoulder washer
3SH Alternate spring grounding hole
3SP Support plate
3SW Spring washer
3W Pin welding hole
37 Fixed link dimension
40A Drawer assembly
40 Coupler link drawer
40A Anterior drawer end panel
40B Drawer base
40C Right drawer side panel
40P Posterior drawer end panel
41R Right anterior column assembly
41L Left anterior column assembly
42R Right posterior hanger assembly
42L Left posterior hanger assembly
47R Right fixed link bracket
47L Left fixed link bracket
4AB Anterior bearing hole
4E Handle
4H Welded pin fastening
4P Fastening clip
4PA Posterior bearing hole
4PB Alternate posterior bearing hole
4S Spacing washer
50A Container assembly
50 Container
50CL Left container side panel
50CR Right container side panel
50B Container base
50E Anterior container end panel
50P Posterior container end panel
5B Stop position Bolt
5N Stop position Nut
5W Stop spacer washer Description of Proportional Linkage The initial embodiment of this invention incorporates a proportional double lever four bar linkage. It is very difficult to plainly reveal the novel proportions by technical prior art, therefore a graphical method provides the best illustration. A graphical and geometric procedure developes the basic proportional link dimensions and gravitational orientation of the linkage. The supported element comprises the coupler link mass positioned within the double lever proportional linkage. Referring to the drawings initial description of the proportional linkage embodied in this invention are best illustrated through planar kinematic drawings.

Referring to FIG. 1A the basic proportional dimensions of the linkage can be graphically originated through simple geometric and mathematical procedures.

A basic rectangle P8 is graphically produced comprising the following steps:

a. establish a basic vertical dimension P1 of 1 unit, and b. construct a square P2 using side dimensions equal to P1 of 1 unit, with P1 comprising a anterior side for basic orientation within the structural applications, and, c. with the diagonal P3 of the square P2 rotate the diagonal P3 to the horizontal originated from the corner having the upper end point P4 of P1 thereby establishing the horizontal dimension P5 of 1.414 unit, and, d. extend the horizontal dimension P5 by 0.05 of itself, calculated by multiplying 0.05 by 1.414 unit equaling 0.0707 unit, and by adding the 1.414 unit and 0.0707 unit thereby establishing the basic horizontal dimension of 1.484 unit, and, e. construct a basic proportional rectangle P8 comprising the basic vertical dimension P1 of 1.0 unit and the basic horizontal dimension of 1.484 unit.

Figure 1B:
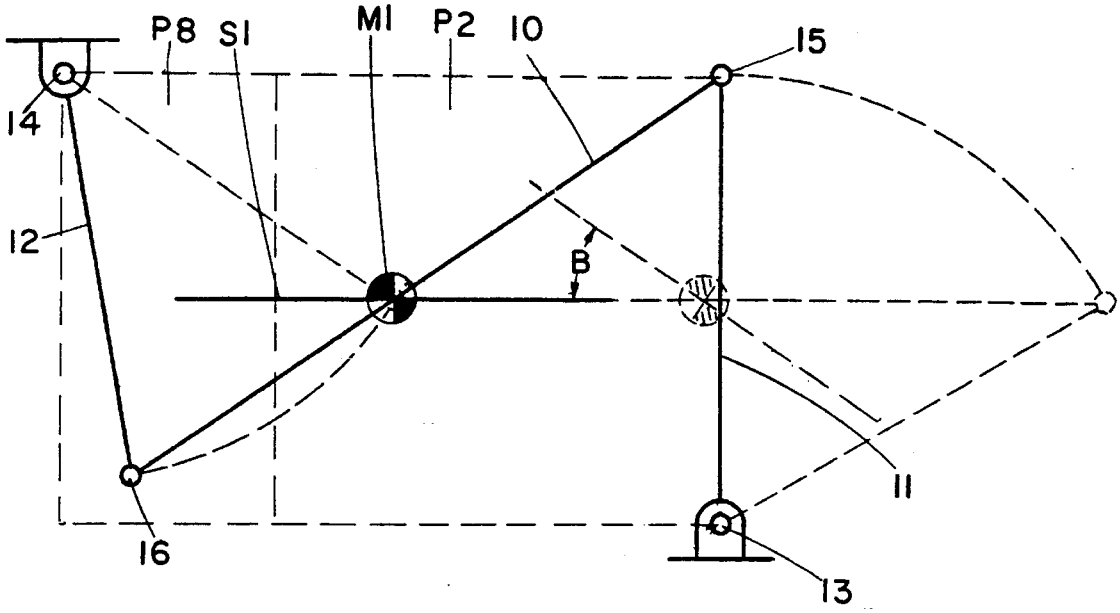
FIG. 1B is a kinematic view of the proportional linkage displaced to a initial cross linked position having a basic prepositioned center of mass about the support linkage assemblies.

Utilizing the basic rectangle P8 as a template construct the proportional linkage FIG. 1A and FIG. 1B comprising the following steps:

a. construct a anterior fixed pivot 13 at the base of P1, and, b. from the pivot 13 construct a anterior supporting link 11 equal in vertical dimension to P1 of 1 unit and at the upper end of link 11 construct a pivot 15, and, c. at the upper posterior corner of rectangle P8 construct a posterior fixed pivot 14 which is diagonally opposed to the fixed pivot 13, and construct a fixed link 17 of 1.79 unit between the fixed pivots 13, 14, where the fixed link is not drawn but is typically known to be between the fixed pivots, d. and, from the posterior fixed pivot 14 construct a posterior supporting link 12 extended one half of the diagonal dimension of P8 between the fixed pivots 13, 14, equaling 0.89 unit and at the lower end of link 12 construct a pivot 16, which corresponds with the midpoint M0 between the fixed pivots 13, 14, and, e. from the midpoint M0 located lower posterior link pivot 16 construct a coupler link 10 extended along the horizontal and over the fixed pivot 13 and ending at the point where the pivot 15 of the anterior link 11 intersects said horizontal coupler link of 1.6 unit when the anterior link 11 is rotated to the right, and, therefore completing the basic proportional four bar linkage in the initial posterior link dead center position.

FIG. 1A and FIG. 1B comprise kinematic illustrations of the proportional double lever four bar linkage representing initially definitive movement positions. A initial dead center position FIG. 1A and a initial cross linked position which includes a vertical position of the anterior link 11 FIG. 1B illustrate positions descriptive to the operation of this invention.

Posterior linkage movement in the dead center position FIG. 1A establishes concentric movement about the fixed pivot 13. Transmission of the proportional linkage to the crosslinked position FIG. 1B establishes substantially horizontal movement of coupler link 10 between the fixed pivots 13, 14. Movement from the initial dead center position to the initial crosslinked position provides a basic anterior range of transmission between substantially concentric and horizontal movements. The initial dead center position includes the horizontal coupler link 10 and the initial crosslinked position includes the vertical anterior link 11. A initial posterior range of movement in continuation beyond the vertical anterior link 11 position provides a cradled movement position FIG. 1C heretoafter described.

Description/Operation of Proportional Linkage

The support of storage elements and supplies best provide exemplary applications of this invention. The proportional linkage provides a remarkable control of the movable mass. A basic description focuses on the structure and movement conditions as a matter of structural arrangements. Storage elements support a wide range of movable mass. Exemplary applications provide a range of function from visual access to storage. The storage elements center of mass varies with the storage contents. Storage elements composing full and partially full capacity provide similar operations. The support of elements other than storage elements provides similar applications of this invention.

The basic operation incorporates a container as a coupler link element with the coupler link center of mass positioned along the path of parallel supporting linkage movement. Initial kinematic descriptions correspond to full closed storage FIG. 1C and partially full open FIG. 1D compositions. Anterior and posterior supporting links 11, 12 of similar constructions distribute substantially equal weight about the assembly center of mass. The initial crosslinked linkage position FIG. 1B establishes the intersection of fixed link 17 and coupler link 10 which substantially coincides with the midpoint M0 between the fixed pivots 13, 14. The mass of the coupler link elements is constructed about the axis of the midpoint M0 in the crosslinked position, thereby establishing a basic coupler link center of mass position M1 within linkage motion. The initial center of mass position M1 best provides a foundation for design applications. Substantially horizontal linkage movement transmits the center of mass M1 across the fixed link midpoint M0. The coupler link center of mass M1 glides between substantially vertical supporting links 11, 12. The coupler link supported element incorporates substantially horizontal movement of the center of mass between upper and lower supporting links 11, 12. Proportional over and under substantially vertical support divides the coupler link element weight providing a poised horizontal movement. Simply stated, the initial coupler link center of mass is poised in substantially horizontal movement, vertically aligned about the middle of the fixed pivots 13, 14.

Reversable movement between the illustrated positions promotes inclination of the coupler link 10 between the inclined cross linked position FIG. 1A and the substantially horizontal link position FIG. 1B. The supporting links 11, 12 rotate in opposite directions, clockwise with counterclockwise. Opposing rotations of the supporting links 11, 12 about fixed pivots 13, 14 substantially counterbalance movement of the supported element. Anterior movement of the vertical anterior link 11 over fixed pivot 13 increases posterior horizontal compressive forces against the anterior fixed pivot 13 correspondingly increasing anterior horizontal tensile forces against the posterior fixed pivot 14. Anterior linkage movement of the initial center of mass M1 imparts a counterbalanced coupler link mounting of the fixed pivot 13. Anterior and posterior links 11, 12 react together substantially counterbalancing movement between the initial horizontal and concentric movement positions. Linkage balancing operations provide substantially counterpoised inclinations of the coupler link elements between horizontal and concentric movement positions.

Figure 1C:
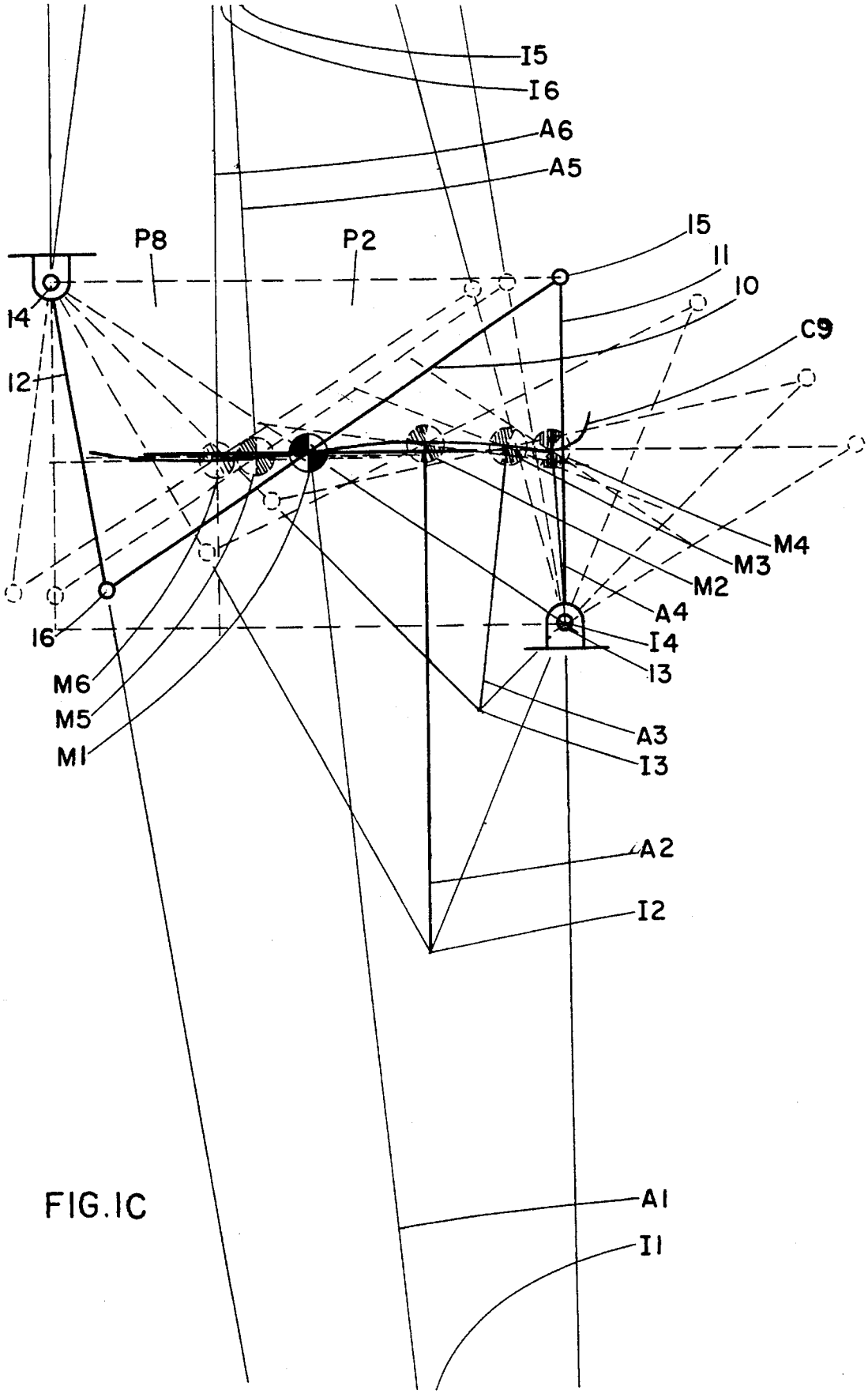
FIG. 1C is a kinematic view of description alignments of the center of mass displaced from the initial crosslinked position.

Linkage assembly movement of the initial midpoint originated center of mass FIG. 1B establishes a substantially horizontal S shaped coupler curve C9 partialy illustrated in FIG. 1C. Assembly movement to the dead center position displaces the center of mass along coupler curve C9 to a position M4. A upper arch convex portion of the coupler curve C9 substantially between M1 and M4 positions illustrates a novel range of movement from the restrained vertical anterior link 11 position.

Figure 4B:
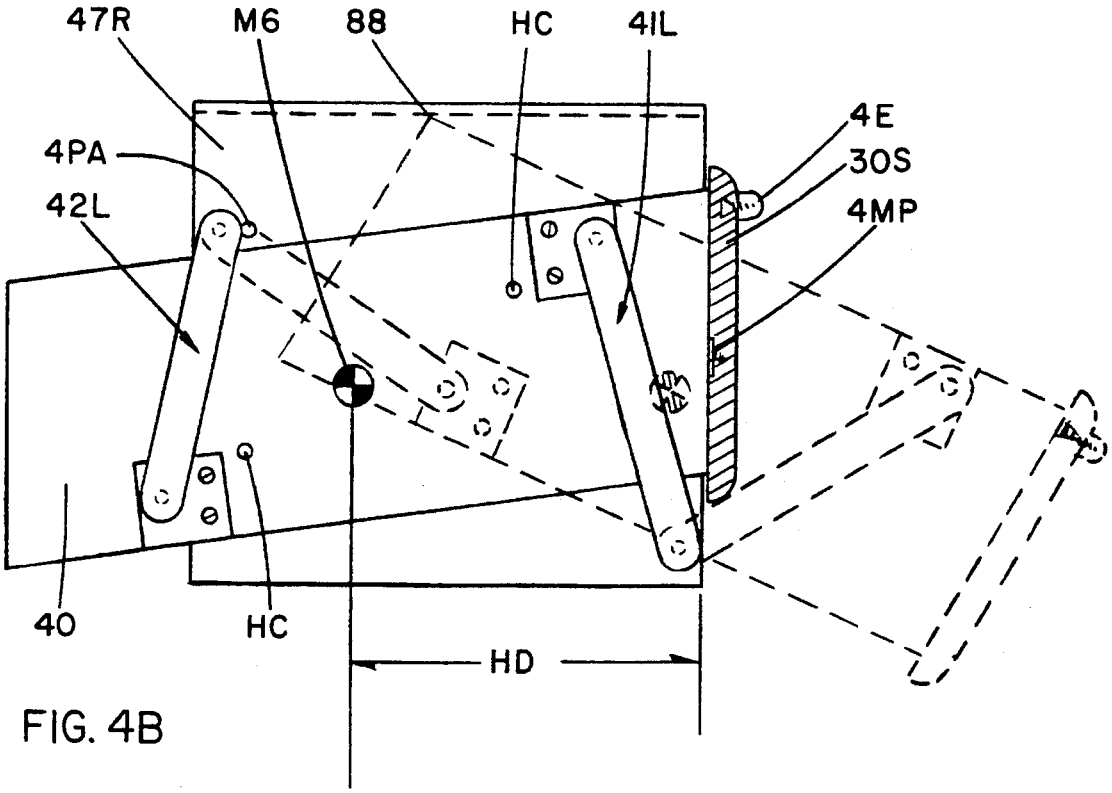
FIG. 4B is a sectional view taken along 8—8 with the drawer retracted to a closed position in FIG. 3.

In the dead center position the coupler link element center of mass hovers over and between the parallel fixed pivot 13 centers M4 substantially dividing support between parallel transposed over and under supporting links 11, 12 FIG. 4. Proportional upper and lower transposed support of the center of mass in position M4 substantially balances the center of mass poised over the center of fixed pivot 13 FIG. 1D. The inclined position of the anterior link 11 substantially limits vertical anterior link 11 movement promoting stability about the concentric movement position. The dead center linkage position substantially stabilizes movement of the hovering coupler link center of mass. Simply stated, the dead center position hovers the center of mass centrally aligned about the axis of the fixed pivot 13 centers.

Combined proportional elevation and lowering of parallel opposing acting links 11, 12 confine a balance of gravitational forces within inclinations of the counterpoised coupler link 10. Movement of the elevating links assisted by movement of the lowering links substantially reduces the enguagement force requirements. The lowering supporting links enguages a reflex action against the elevating supporting link providing counterpoised coupler link element enguagements. Counterpoised rotations provide a repeated ease of enguagement with restraining storage element inclination about parallel linkage movement instant centers.

Restrained links motion between the middle alignment and central alignment positions enguages the operation with counterpoised inclination of the storage element mass. Horizontal displacement of center of mass between the initial vertical anterior links position and the dead center position substantially equals one half the horizontal span between the fixed pivots 13, 14. The initial center of mass crosses one half the span of the fixed pivots between the middle and central alignments. Substantially vertical crosslinked support transfered to transposed dead center inclined links support transfers inclination of the counterpoised storage element mass.

Various center of mass applications enjoy a similar range of horizontal displacement and inclination. Various proportional applications adjusting basic dimensions and providing similar transmissions between middle and central alignments employ the intended use of this invention. The middle to central alignment description promotes a simple vertical conception of this invention. A model construction presentation best endeavors to demonstrate the poised operation of this invention. Middle to central references are not intended to limit use but intend to promote basic reference to various applications incorporating the spirit and intent of this invention.

Posterior movement of the coupler link mass from the position having the vertical anterior links 11 combines posterior compressive forces and posterior tensile forces between supporting links 11, 12. Posterior linkages motion over the anterior links 11 vertical position seperates anterior and posterior operations. Combined posterior forces seperate the posterior movement positions from the initial anterior movements. The cradled movement position rests in various positions determined by the concentrations of mass. Posterior movement beyond the posterior links 12 vertical position increases the anterior horizontal tensile forces against the posterior fixed pivots 14 correspondingly increasing the posterior horizontal compressive forces against the anterior fixed pivots 13. Opposing rotation of posterior and anterior links 12, 11 substantially counterpoise horizontal forces imparting counterbalanced movement about the cradled position. A lower concave portion of coupler curve C9 substantially between M1 and M6 positions cradles the center of mass below a parallel linkage instant center I6. Heretoafter described the cradled center of mass position and the instant center I6 comprise a vertical alignment A6 FIG. 1C. The descriptive alignment A6 corresponds with the posterior boundry of the square P2 of the proportional linkage constructions FIG. 1A. The center of mass aligns with proportional linkage instant center positions providing various cradled positions of the storage element and is best limited between the anterior and posterior boundries of square P2.

Linkage movement in the cradled alignment position unites posterior counterpoised supporting links 11, 12 about the storage element center of mass. The resting cradled position varies substantially with the center of mass of storage element contents. Partially full storage elements provide lower center of mass operations. Lower center of mass operations contain perpendicular displacement arms apart from the coupler link 10. Inclinations of lower center of mass displacement arms reduces the horizontal displacement of the center of mass between initial cradled and concentric motion positions. Higher center of mass displacement arms increase the horizontal displacement of the center of mass between initial cradled and concentric motion positions. A basic range of storage element dimensions are best limited by confining the movement of the coupler link element center of mass within the boundries of the square P2 FIG. 1A.

The anterior range of motion provides a simple description and application of this invention. A continuous posterior unrestrained movement provides the additional cradled position of the center of mass M6. A complete range of movement between cradled and concentric movement positions FIG. 1C illustrates a complete novel movement incorporated within the applications of this invention.

The design of various link dimensions are best determined or adjusted by linkage constructions in relation to the vertical anterior link 11 position. Various link dimensions apart from initial dimensions generally reduce the horizontal displacements, alter the range of movement and shape of the corresponding coupler curve. Various link dimensions comprising simple, non S shaped, coupler curve movement of various center of mass constructions enable similar operations in some open latching applications.

Illustrations provide proportions graphically inclusive to operations and adjustment within the supporting applications. Various dimensions of horizontal span P7 combined with various coupler links 10 dimensions best define adjustment variations of the basic linkage. FIG. 1F illustrates a alternative position of the parallel fixed pivots 14 corresponding with the posterior end of the horizontal dimension P5. This alternative fixed position of the described linkage provides greater coupler link inclination. The basic and alternative fixed pivot positions provide a basic dimensional range of linkage adjustments. Furthermore, as will be obvious to one skilled in the art, many variations and modifications of dimensions may be used in the practice of this invention without departing from the scope and spirit as set forth in the preceding description and claims.

Description/Operation of Storage Mass Applications

Storage element applications employing the balancing features of this invention surround various storage materials mass. The support of many types of material are possible. Volume containers constructed substantially between parallel basic rectangles P8 provide a volume of mass which substantially comprises the initial center of mass in position M1 between parallel linkages. A basic model of storage element volume constructed in the initial vertical anterior link position between parallel basic rectangles P8 comprises in combination;

a. construction of coupler link side panels comprising the height and depth dimensions of the basic rectangle P8, and, b. construction of base element width dimension substantially comprising single digit multiples of the height dimension of the basic rectangle P8, and, c. construction of front and back side panels corresponding with the base element width dimensions and side panel height dimensions, whereby the construction of extensions, alterations to inclination restrictions, top panels or counterbalancing mass elements provide substantially symmetrical horizontal distributions of mass about the midpoint M0 axis between parallel coupler link side panels.

The support of elements of negligable mass requires supporting structure which substantially provides all of the mass constructed about the center of mass position M1. Height dimensions of side panels provide bearing areas for fastening the pivotal supporting links. Referring to FIG. 1B establishment of a horizontal line intersecting the center of mass position M1 graphically illustrates a initial basic line of horizontal inclination S1 applied to the coupler link 10 within the supporting surfaces of the application FIG. 3C. The line S1 illustrates the horizontal coupler link in the initial cross linked position. Proportional inclinations of the basic line S1 are graphically illustrated FIG. 1C coincident with center of mass positions within the supporting application FIG. 3C. The line S1 illustrates angles of anterior inclination of initially horizontally positioned elements. The illustrated linkage movement provides degrees of angle B FIG. 1B of the line S1 with the horizontal which is substantially similar to angle A FIG. 1A of the horizontal and proportional fixed pivots inclination employed within the supporting applications. The range of linkage inclination enables the orientation of supported elements in many positions. To one skilled in the art, rotational movements based on proportional dimensions provide proportional angular movements of mass descriptive within the prior art formula.

Figure 1D:
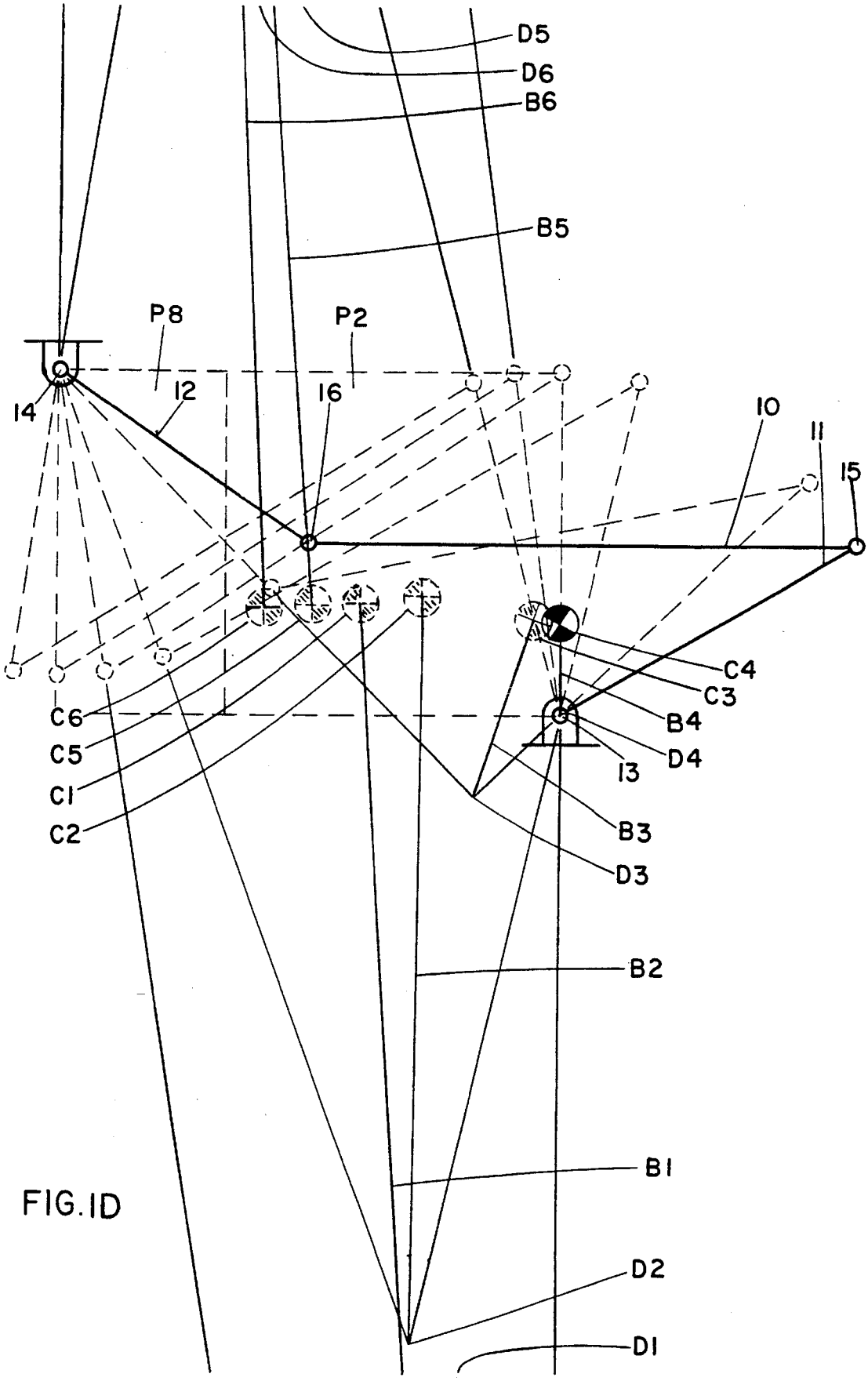
FIG. 1D is a kinematic view of descriptive alignments of the displaced from the initial dead center position.

Referring to FIG. 1C, 1D exemplary linkage movement operations combine relative description of assembly operations. Several assemblies incorporating the proportional linkage with interchangable assembly parts promotes wide and varied use of this invention. The basic dimensions illustrated within the initial kinematic drawings are employed within the constructive applications. Alterations of proportional dimensions providing similar S shaped coupler curves of mass movement between horizontal and concentric movement positions employ the intended use of this invention. The support of various supplies and supporting structures about proportional linkages provide similar counterpoised inclination operations. Movement descriptions following the constructive applications intend to expand basic comparative understanding of the operations of this invention and odes not intend to limit different operations to the basic descriptions. Combined description of movement alignments FIG. 1C, 1D technically promotes wide and varied usage of this invention, heretoafter described.

Supporting a wide range of compositions of mass requires various constructive applications. A basic range of supporting mass applications employing the proportional linkage comprise;

a. a linkage apparatus comprising plural proportional guide linkage assemblies provides prepositioned fastening of elective storage elements mass between parallel linkages and frame.

b. a storage display rack assembly provides anterior inclination of a counterpoised storage shelf supporting paper, and materials of negligable mass.

c. a coupler link drawer assembly provides anterior inclination and cradled storage of counterpoised drawer and volume supplies mass.

d. a coupler link container assembly provides anterior inclination of a counterpoised storage container and volume supplies mass.

whereby these assemblies best promote a minimum of descriptive uses and supporting applications of this invention.

DESCRIPTION/OPERATION OF SUPPORTING ELECTIVE ELEMENTS

Figure 2A:
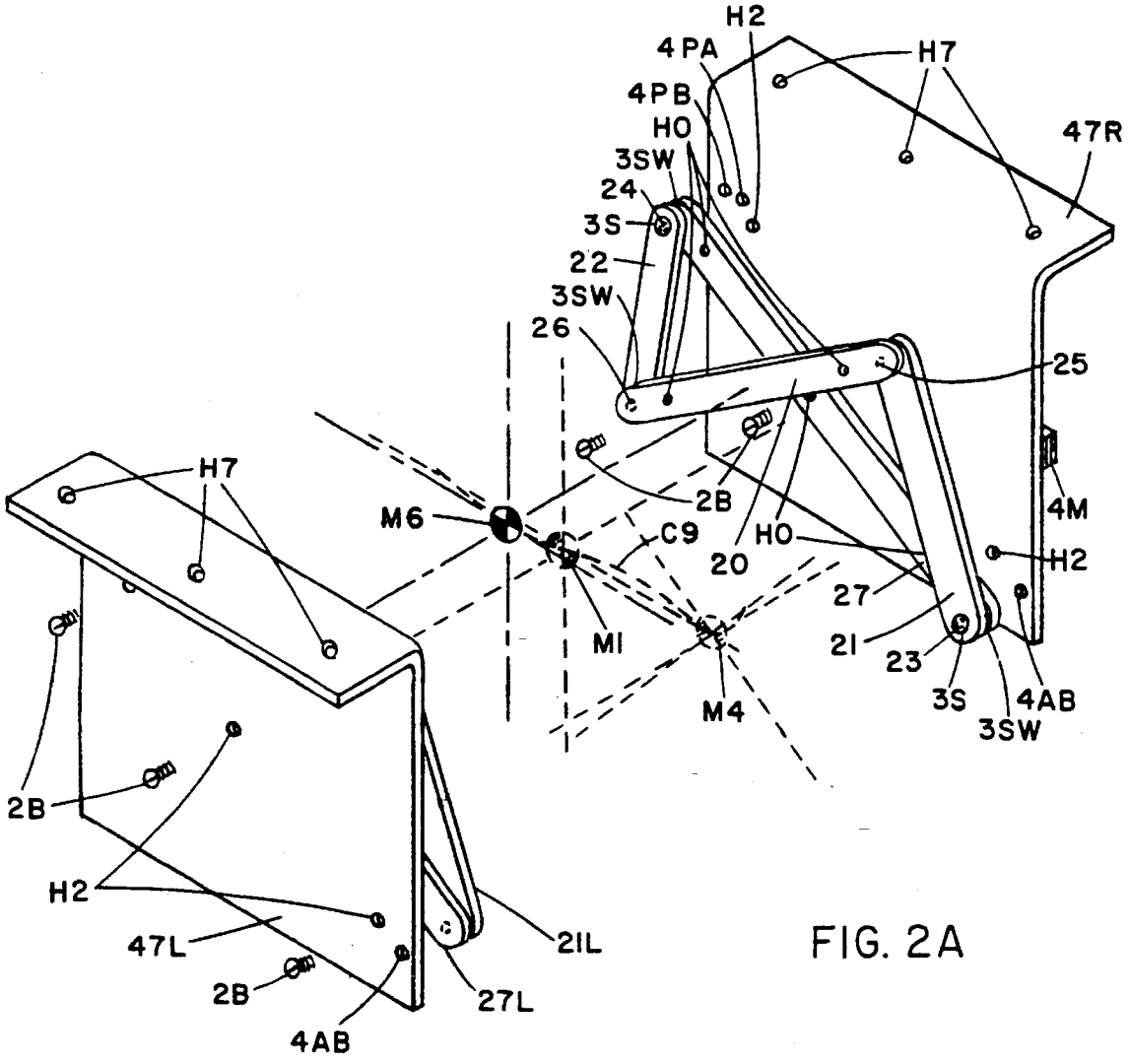
FIG. 2 is a right side linkage apparatus assembly.
Figure 3:
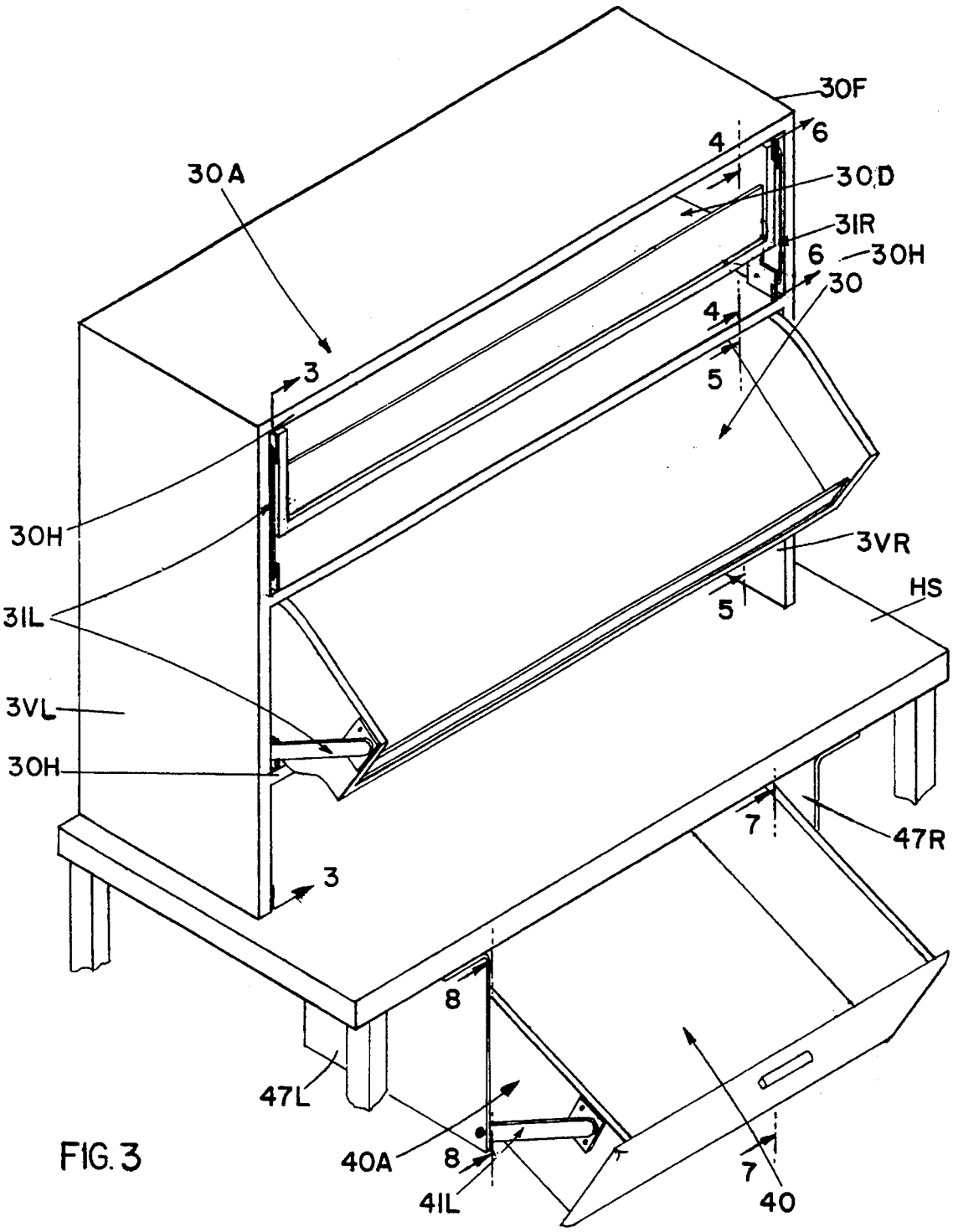
FIG. 3 is a view of a storage display rack and a drawer assembly supported by a table.
Figure 3A:
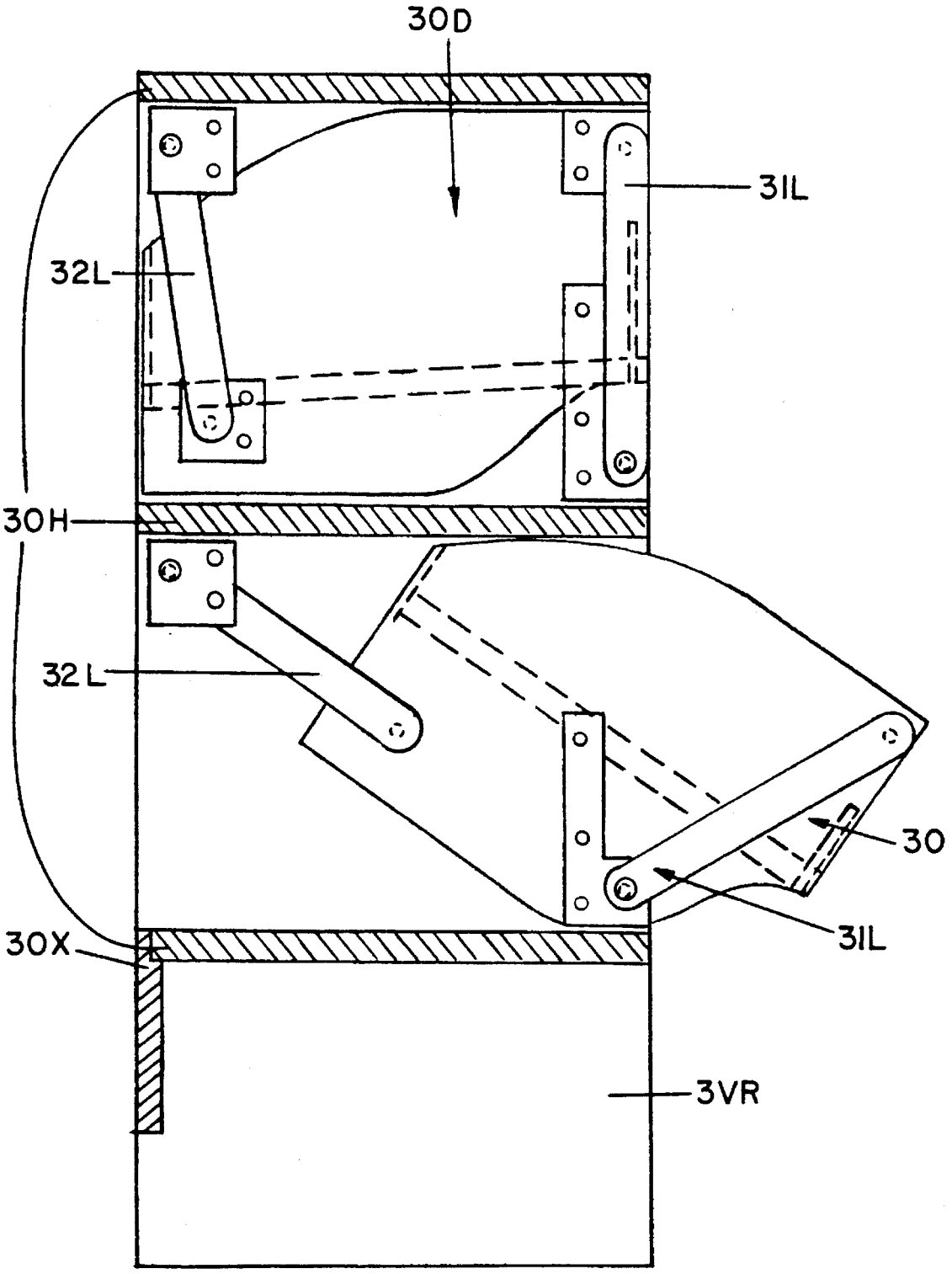
FIG. 3A is a sectional view of the storage display rack taken along 3—3 in FIG. 3.
Figure 3C:
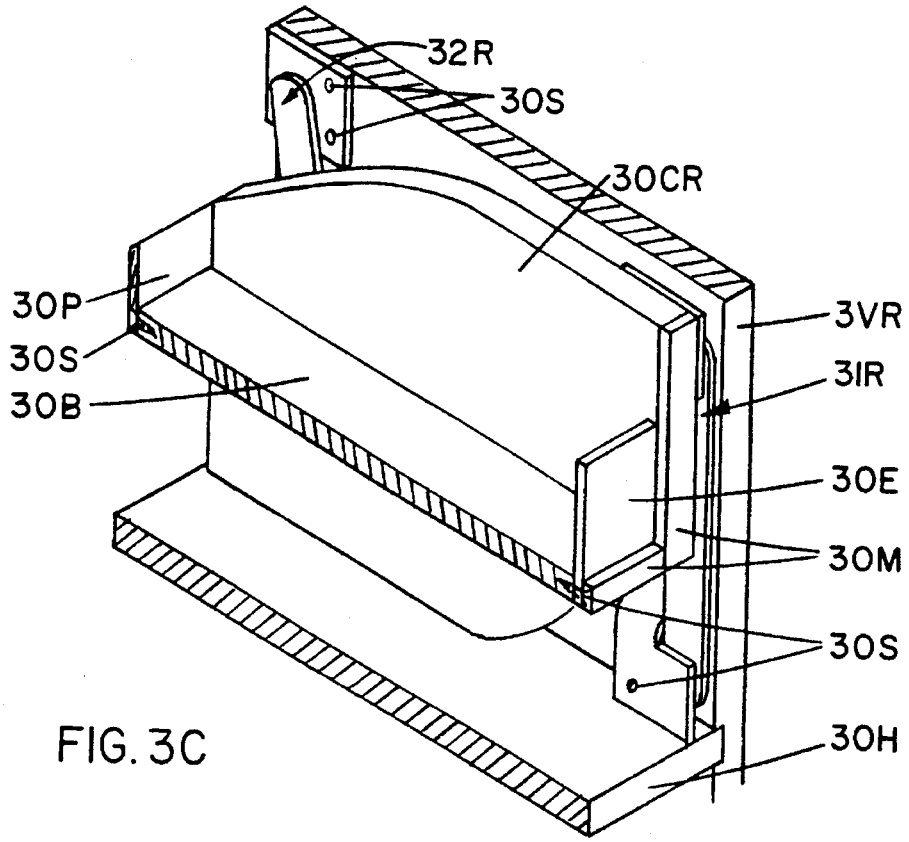
FIG. 3C is a sectional isometric view taken along 5—5 in FIG. 3 with the shelf retracted to a closed position corresponding with the alternate shelf view in FIG. 3B.
Figure 3D:
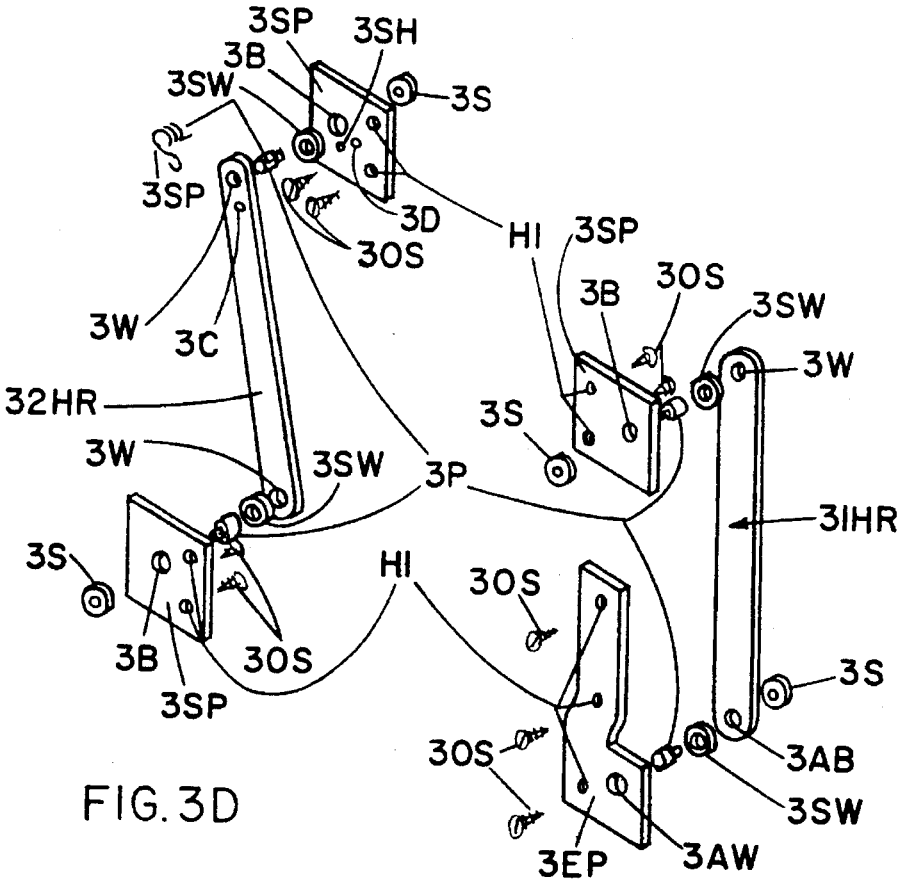
FIG. 3D is a fragmented sectional isometric view of the typical column and hanger assemblies taken along 6—6 in FIG. 3B.

The linkage apparatus assembly 20A employs the proportional linkage providing parallel right FIG. 2 and inverted left fastening between the elective supported element and parallel vertical standards. The elective supported elements center of mass is determined and positioned about the described coupler link center of mass position and along a perpendicular axis between parallel linkage apparatuses. The proportional linkage apparatus comprises in right side combinations of:

a. rigid proportional fixed link element 27, having threaded hole H0 fastened by bolts 2B by example through holes H2 of interchangable vertical standard 47R FIG. 4A, having lower end anterior pin 23 fastened with, b. the lower pivotal end of a rigid proportional dimension anterior column link element 21, having pivotal end fastened with, c. the anterior end pin 25 of a rigid proportional dimension coupler link element 20, having threaded holes H0 fastened by bolts 2B through holes HC by example within drawer 40 by example FIG. 4A, having posterior end pin 26 fastened with, d. the lower pivotal end of rigid proportional posterior hanger link element 22, having upper pivotal end fastened with the upper posterior end fastening pin 24 of fixed linkage element 27, with the pivotal end fastening having typical optional spring spacing washer 3SW constructively illustrated in the FIG. 3D pivotal assemblies, and, therefore completing the right proportional linkage apparatus assembly reversably comprising the left linkage apparatus whereby the elective supported element is positioned about the coupler link center of mass in position M1 and fastened between parallel linkage apparatus and vertical standards.

The determination of elective supported elements center of mass positions can be substantially determined through intersecting lines of plural parallel cable suspensions of the elective element or through binary weight scales calculations. Further methods of determining center of mass or center of gravity positions are available through prior art methodology. Constructions based on the elective elements center of mass and volume establish various positioning applications of this invention. Support assembly operations provide for the ease of balanced adjustment and constructive positioning of supported elements by test enguagements. The operator observes variations of poised movements based on the variations of supplies stored and removed from the supporting element. Volume restrictions compared with basic anterior link dimensions and center of mass positions combine to limit the practical utilization of inclined assemblies in some instances.

Typical construction of the right linkage apparatus FIG. 2 reversably comprises the left linkage apparatus. The illustrated application comprises metal constructions but plastic, rod or various rigid material constructions could provide suitable applications. Typical pivotal pin fastenings between the link elements are constructed within the storage display rack 30A FIG. 3D. The welded pin fastenings are constructed within metal linkage elements 27, 20 in this application. Linkage elements ground circular ends provide reduced potential for restriction with extended use. Molded constructions of plastic link elements construct the welded fastening within the moulding process. Posterior hanger elements supporting tensile forces could be made of cable or suitable tensile material in some applications.

Example fastening within parallel linkage apparatus supports the drawer 40, shelf 30, 30D, container 50 within right and left brackets 47R, 47L. The interchangable drawer 40 is constructed within the drawer assembly FIG. 4A. Parallel linkage apparatus replace anterior column assemblies and posterior hanger assemblies comprising similar drawer assembly operations. Holes HC are provided within the drawer 40 providing bolt 2B fastening with coupler link element 20. Holes H2 within right and left brackets 47R, 47L provide bolt 2B fastening with the fixed link element 27. Various rest positions can be determined by supported element restraint or link element restraints within various linkage apparatus applications. The influence of gravitational forces acting on parallel right and left linkage apparatus assemblies unite parallel proportional anterior and posterior link rotations promoting concurrent parallel inclinations. Proportional linkage apparatus assemblies provide simple and easily fastened constructions within various assembly applications.

Description/Operation of Paper Storage

A storage display rack linkage assembly 30A FIG. 3 provides inclinations of counterpoised shelf assemblies supporting paper, magazines and substantially planar materials of negligable mass variation. This display rack comprises structure substantially providing the center of mass position M1 and comprising the majority of the transmission mass. Relative technical descriptions combining gravitional centers and linkage instant centers operated about the alignments A1, A2, A3, A4 correspond with the storage display rack linkage assembly, FIG. 1C.

Referring to FIG. 3 the storage display rack is generally identified 30A comprising in combination:

a. frame assembly 30F comprises right and left vertical standards 3VR, 3VL, horizontal standards 30H, lateral stabilizer 30X FIG. 3A, providing for inclined fixed links fastening with the vertical standards with the frame typically screw fastened by glued constructions, and, b. shelf element 30 with horizontally positioned base and alternate shelf element 30A with posterior inclined base in the initial vertical anterior column position providing substantially planar storage operations and comprising in right section combinations of;

1. planar shelf element base 30B, 30BA fastened with,
2. right typical contoured coupler link side panel 30CR, and,
3. anterior end panel 30E, 30EA confining stored materials within shelf element 30, 30A movements, optionally providing visibility of materials through opaque panel material, and,
4. posterior end panel 30P, 30PA confining stored materials within shelf element 30, 30A movements, and,
5. anterior moulding 30M,
   with the element fastened by screws 30S with glued construction, and, c. plural parallel right and left anterior pivotal column assemblies 31R, 31L, d. plural parallel posterior right and left hanger assemblies 32R, 32L, FIG. 3, FIG. 3D.

Parallel right and left pivotal column and hanger assemblies 31R, 31L, 32R, 32L are constructed of metal and could be constructed of plastic or other materials. Typical exemplary proportional construction FIG. 3D of right anterior column assembly 31R and right posterior hanger assembly 32R comprises in combination:

a. typical upper and lower end right posterior hanger 32HR and upper end anterior column 31HR connected by weld through typical hole,
   1. and providing within the upper posterior hanger alternate detent 3C providing restrictive motion control in combination with opposing indetent 3D in support plate 3SP, and, b. typical shoulder fastening pin 3P providing suitable axial thrust tolerance inserted through, c. spacing spring washer 3SW, and, 1. providing alternate positioning of washer 3SW between end shoulder washer 3S and support plate 3SP in combination with indetent 3D and opposing hanger detent 3C providing alternate restrictive motion control applications, and, d. providing alternate spring 3SP when counterbalancing assymetrical anterior loads, and, pin 3P inserted through, e. typical support plate 3SP comprising;
   1. pivotal bearing holes 3B surrounding pin 3P with suitable radial spacing tolerence, and,
   2. holes H1 for fastening by screws 30S to vertical standard 3VR and side panels 30CR respectively, and,
   3. providing alternate spring grounding pin hole 3SH, and,
   4. providing alternate indetent 3D providing additional motion control in combination with hanger detent 3C in assymetrical load conditions, and, pin 3P inserted through, f. spacing end shoulder washer 3S and fastened by riveting together, and, g. the lower end anterior column comprising;
   1. lower end right anterior column 31HR having pivotal bearing hole 3AB surrounding,
   2. shoulder fastening pin 3P welded to,
   3. anterior lower support plate 3EP having extended portion bent to provide planar restriction to posterior column movement with holes H1 providing screw fastening to vertical standard 3VR, with fastening inclination enabling adjustable stop positions, and, pin 3P inserted through,
   4. spacing shoulder washer 3W and fastened by riveting together, with the columns and hangers comprising proportional pin to pin dimensions established within the proportional linkage and enabling various fastening positions providing for potential adjustments of the basic proportional coupler link and fixed link dimensions.

whereby shelf elements constructed substantially about the provisional center of mass positions comprise wide and various sizes of proportional display rack assemblies.

Shelf elements 30 are constructed of wood, plastic and metal screw materials readily available and could be constructed of plastic, metal, or suitably rigid materials. Basic rectangle P8 combined with pivotal fastening dimensions provides a basic area of side panel constructions. Sheet metal construction of folded shelf elements could provide for unit construction of shelf elements. Anterior and posterior pivotal fastening of side panels are comprised of foulded upper and lower portions of the shelf base element. Folded posterior end panels could provides posterior upper side panel constraints. Plastic moulded constructions could provide similar unit shelf elements.

Movable shelves are alternately spaced between stationary shelves. Horizontal standards HS comprise the stationary shelves and provide restrictions to inclination with the basic rectangular side panels. Contoured side panels 30CR, 30CL are constructed to fill the movement space between the stationary shelves throughout opening and closing. The upper contoured reduction of the basic rectangular area of sides panels 30CR follows the limiting restrictions of the stationary shelves. The lower contoured S shaped lower anterior cut out portion of basic rectangular area of side panels reduces potential lower restrictions in the inclined display position. Upper contoured posterior reduction of the basic rectangular area combined with lower anterior reduction provides substantially balanced side panels 30CR, 30CL constructed about the initial prepositioned center of mass M1 position within parallel linkages.

The shelf element base 30B is horizontally positioned. The shelf element base 30BA is positioned in posterior inclination below the initial prepositioned center of mass position M1 and provides for the stacking of planar materials substantially balanced about the initial center of mass position M1. The posterior inclination provides the horizontal positioning of materials in the transfer position between horizontal and concentric movement positions. The initial shelf base posterior inclination reduces the anterior inclination of the inclined shelf and movable supplies.

Anterior and posterior end panels of differing mass best provide balanced adjustments to anterior concentrated storage operations. Posterior panels comprising greater density materials best provide for the balance of accessable materials placed in the anterior storage areas. Counterweight CW screw attached to the posterior area of the shelf provides adjustment of balanced operation are best provided by the operator. The display storage rack assembly application provides easily operated inclined display functions incorporating linkage support assembly operations.

Description/Operation of Drawer Storage

A drawer assembly 40A FIG. 3 incorporates proportional linkage support assembly operations providing cradled support and opening and closing inclination of counterpoised drawer and volume supplies mass. This drawer assembly supports substantially varied center of mass operations based on the volume of stored material. Relative descriptions based on alignments A1, A2, A3, A4, A5, A6 correspond substantially with full drawer operations, FIG. 1C. Relative descriptions based on alignments B1, B2, B3, B4, B5, B6 correspond substantially with partially full drawer operations, FIG. 1D, heretoafter described.

Referring to FIG. 3 drawer assembly 40A comprises in combination;

a. right and left brackets 47R, 47L comprising vertical standards fastened to the horizontal standard HS through fastening holes H7, providing fixed link 47 fastening FIG. 4A between anterior column assembly 41R fastening hole 4AB and posterior assembly fastening hole 4PB and alternate fastening hole 4PA established at the posterior end of the horizontal dimension equaling 1.41 unit extended from the upper end of the vertical anterior link P1, and, b. coupler link drawer 40 comprising in combination;
   1. base element 40B fastened with,
   2. right and left coupler link side panels 40C fastened with,
   3. anterior end panel 40A, with handle 4E screw fastened and,
   4. posterior end panel 40P,
   elements screw fastened by glued construction, with the drawer 40 supported by, c. parallel right 31R and left 41L anterior column assemblies and, d. right 42R and left 41L posterior hanger assemblies.

Parallel right 41R, 42R and left column and hanger assemblies comparing in combination:

a. typical upper anterior and lower posterior pivotal end construction corresponding with column and hanger assemblies 31R, 32R, within display storage rack, FIG. 3D, and, b. a typical right lower anterior, upper posterior pivotal end construction comprising;
   1. a anterior column 41HR and posterior hanger 42HR fastened through hole 4H by weld with,
   2. slotted fastening pin 4P inserted through,
   3. spacing washer 4S and through,
   4. anterior bearing hole 4AB and interchangably through posterior bearing holes 4PB and 4PA in bracket 47R and through,
   5. spacing washer 4S and,
   6. fastened by removable pin clip 4P around slotted pin 4P.

Posterior restraint of drawer 40 is provided through drawer anterior panel 40A contact with brackets 47R, 47L. Magnetic restraint 4M and magnetic plate 4MP latching between the end panel 40A and the vertical standards provides the widely used magnetic latching of drawer assemblies.

The drawer element 40 is constructed of wood materials and could be constructed of plastic, metal, or suitably rigid materials. Initial drawer constructions can be modeled by section about rectangle P8 with symmetrical extensions and adjustments for surrounding restrictions to inclination. Movement of the initial center of mass along coupler curve to the M6 position provides a vertical alignment A6 suspended below the linkage instant center I6 providing the cradled movement position. The cradled position within the illustrated proportional linkage provides a basic limit to gravitationally assisted posterior movements. Substantial stability in the cradled position of the supported mass establishes a basic position for drawer design and construction. The posterior cradled position provides a simple basis for horizontal drawer extensions beyond the basic rectangle. Symmetrical mass constructions of the drawer depth can be increased beyond the basic horizontal rectangular dimension maintaining anterior counterpoised inclination operations. Drawer 40A construction about the cradled center of mass position M6 extended beyond the basic vertical anterior column position enables extended balanced horizontal storage capacities.

Drawer volume constructions are practically related to the anterior column support fastening requirements. The dimension between the cradled center of mass M6 and the anterior edge of column 41 provides a simple basis for one half of substantially symmetrical drawer depth constructions. Anterior and posterior horizontal extensions beyond basic rectangular volume dimensions provide symmetrical mass distributions horizontally balanced about the displaced center of mass.

A basic model of drawer dimensions are substantially established in relation to the proportional linkage in the center of mass position M6 and comprise in combination:

a. a basic height dimension of the anterior column used as a basis for drawer height, and, b. a basic depth dimension between anterior support column 41HR anterior edge and the center of mass position M6 establishs one half of the basic drawer 40 depth HD, with the basic drawer depth comprising substantially double the HD dimension, c. a basic height dimension established in the initial concentric movement position providing dimensions which limit restriction to inclination established between;

1. the lower height limit providing for the basic inclination of the base element 40B between the lower edge of hanger support plate 3SP and the center of the lower anterior column fastening, and providing for unrestricted space about the anterior fastening and, 2. the upper edge of the anterior columns support plate 3SP providing upper height limit inclination parallel with the base element 40B, establishing the basic drawer height and basic inclination in relation to restrictions in the open and closed positions, and, d. basic width dimensions between parallel support assemblies vary substantially based on storage volume requirements, with single digit multiples of the basic height dimension establishing a basic range of width dimensions. The seperation of parallel assemblies beyond a range of 10 multiples of the drawer height dimension reduces the ease of enguaging parallel movement.

Drawer constructions about the cradled center of mass position M6 maintain similar mass transfer operations between the initial movement positions. To one skilled in the art, drawer construction surrounding various center of mass positions describe various applications of this invention.

The height of drawer constructions requires unrestricted space with inclination. The basic vertical dimensions of drawer 40 provides upper posterior restrictions 88 FIG. 4B surrounding drawer inclinations. However, upper posterior height reductions, reduced depth combined with increased posterior mass enable reduced height and upper restrictions to balanced inclination. Drawer 40 inclination supports vertical elevation of posterior panel 40P limited by vertical restraictions 88 such as other drawers or upper horizontal planar surfaces HS. Reduction of the basic posterior drawer depth and height reduces vertical restrictions allowing close stacking of inclined drawer assemblies. Lessor vertical dimension of posterior panel 40P and adjoining side panels 40C of drawer construction requires symmetrical mass construction. Greater density of posterior materials, increased panel dimension 40P, or posterior elective fastened counterweights CW balance reduced posterior dimensions from the center of mass position M6. The posterior concentration of mass within elective counterweights CW FIG. 4A counterbalances anterior accessable concentrations of supplies mass in the inclined drawer position. The need for counterweights will become obvious to the user and repositioning of supplies can easily maintain balanced operations in most instances.

The basic height of drawer 40 provides lower anterior restrictions surrounding drawer inclinations. The anterior inclination of drawer 40 enguages potential opening inclination restrictions below the anterior fastening level between the vertical standards. Reduced anterior drawer height dimensions provides lessor restriction to inclination. Basic height dimension of lessor dimension than column dimension provides lessor restriction in multiple stacking applications.

The center of mass of the constructed drawer can be confirmed through parallel cable suspension, binary scale calculations or adjusted through operations providing counterweight applications. The drawer center of mass axis between opposite side panels is prepositioned and fastened about columns and hangers and enguaged in storage operations. To one skilled in the art, the construction of drawer assemblies composing balanced operations supported about proportional linkage operations will provide obvious adjustment requirements.

Description/Operation of Container Storage

A container linkage assembly 50A employs proportional linkage support assembly operation provides opening and closing inclination of counterpoised container and various supplies. This container assembly comprises full container construction substantially about the midpoint M1 center of mass of basic rectangle P8 providing storage and inclined accessability of volume materials. Relative descriptions based on restrained alignments A1, A2, A3, A4 correspond substantially with full container assembly operations FIG. 1C. Relative descriptions based on alignments B1, B2, B3, B4 correspond substantially with partially full container assembly operation, FIG. 1D.

Figure 5A:
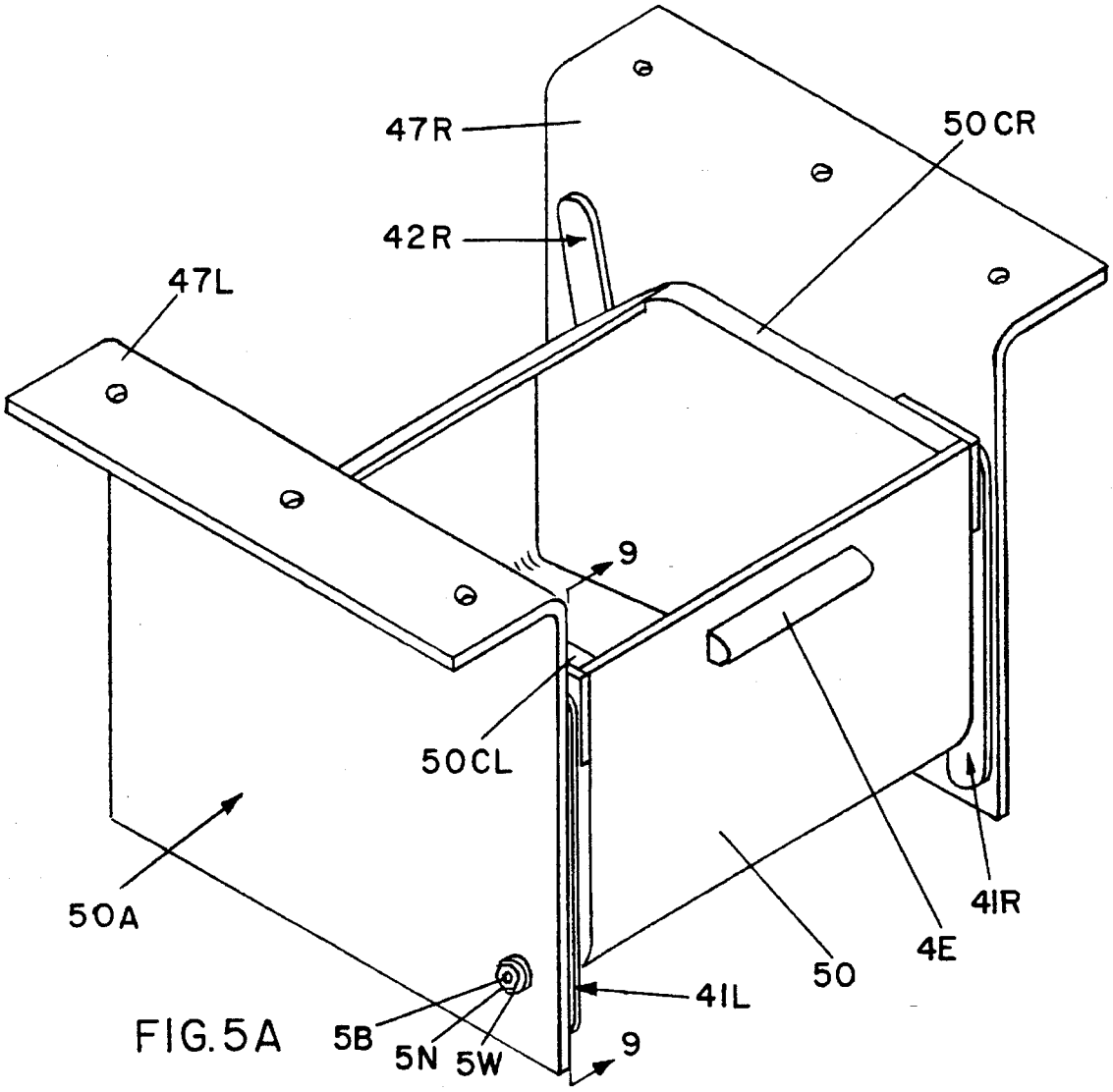
FIG. 5A is a isometric view of a container assembly.
Figure 5B:
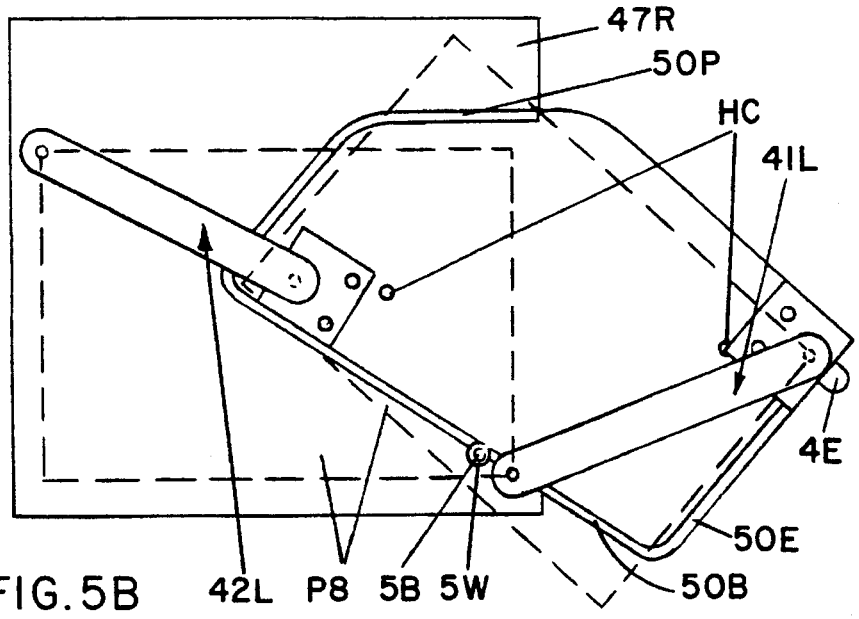
FIG. 5B is a section of the container assembly taken along 9—9 in FIG. 5A.

Referring to FIG. 5A, 5B the container linkage assembly is generally identified 50A comprising in combination:

a. right and left brackets 47R, 47L providing vertical standards fastened through holes H7 to horizontal standards and inclined fixed link dimension 47 supporting in combination, b. anterior column assemblies 41R, 41L pivotally fastened through bearing hole 4AB, and c. posterior hanger assemblies 42R, 42L, pivotally fastened through bearing holes 4PB and alternately through bearing holes 4PA, and, d. container 50 comprising in combination, 1. right and left coupler link side panels 50CR, 50CL, and, 2. a panel folded around side panels 50CR, 50CL to comprise, a. the base bottom panel 50B, and, b. the anterior end panel 50E, with handle 4E screw attached, and, c. posterior end panel 50P, with panels screw fastened with glued sealent.

Container 50 is constructed of wood side panels and plastic foulded panels and could be constructed of metal or suitably rigid materials.

Referring to FIG. 5B the construction of container 50 comprises the basic side panel design and construction about rectangle P8 providing full storage about the initial center of mass position M1. The basic rectange P8 is illustrated in the initial horizontal movement position. The pivotal fastening dimension of support plate 3SP in addition to the basic rectangle P8 establish a base corner for model container 50 dimensions. Movement of the basic rectangle P8 is displaced to a position between the extreme right posterior link coupler link dead center position and the initial dead center position. Stacking requirements of supporting multiple containers establishes the container shape constructed about common areas of overlapping inclinations of basic rectangle P8. The upper posterior portion of the displaced basic rectangle provides potential restrictions above the horizontal basic rectangle. A reduction of container volume above the initial horizontal rectangle reduces potential restrictions to inclination. This reduction allows unrestricted movement about the concentric movement position of the container. The addition of the fastening support plate 3SP dimension above the overlapping rectangular area establishes the upper posterior container folded construction FIG. 5B. The folded panel of the container terminates corresponding with the anterior edge of the support bracket in the open position. An opening between the posterior panel and the anterior end foulded panel provides access to supplies in the open position.

The lower anterior portion of the displaced basic rectangle provides potential restrictions to inclination. A reduction of the container volume below the anterior pivotal support provides a balancing reduction with upper posterior volume reductions. The bottom panel 50B provides initial inclination between the lower posterior hanger support plate 3SP and the lower anterior column bearing hole 4AB. This bottom container inclination reduces lower restrictions and reduces accessable anterior storage volume. The reduction of accessable anterior volume promotes balances operations. The bottom provides posterior inclination in the initial horizontal movement position and passes over the horizontal inclination when transfered between the initial movement positions.

The side panels are constructed to conform to folded plastic panels. The plastic foulded panel is heated and foulded around the contoured side panels and screw fastened with glue sealent. Column and hanger assemblies are fastened conforming to proportional dimensions and assembled between the vertical standards. Stop restraint is provided through bolt 5B fastening of appropriate width and radius washer 5W by nut 5N through lower hole H2 in the vertical standards 47R, 47L.

Storage supplies providing posterior counterweight requirements vary in relation to the container supplies mass. Counterweights substantially balance stored materials and are best defined and positioned by the repeated user.

Operation about Descriptive Alignments

Referring to FIG. 1C, 1D the position of the center of mass in relation to the corresponding instant center of linkage movement graphically illustrates the technical operation of this invention. Relative description of counterpoised operations provides center of mass positions substantially poised about the instant center positions. A line connecting center of mass positions with corresponding instant center positions illustrates combined reference to various poised alignment. Enguagement is assisted by the reflex action of the lowering support link rotation. The inclination of alignment of the center of mass in relation to the corresponding instant center graphically illustrates reflexly poised movement. Alignments in relation to the vertical illustrates reflexly poised movements between anterior, vertical, and posterior directions. Vertical alignments illustrate vertically poised transfer positions between the initial movement positions M1, M4. Enguagement forces bridging the vertically poised position substantially transfer counterpoised elements between horizontal and concentric movement positions. Supported supplies provide various center of mass positions thereby varying vertical transfer positions within the operation of this invention. Alignments simplify basic descriptions of operations promoting wide application of this invention. As will be obvious to one skilled in the art, combined center of mass and instant center alignments best simplify technical assembly descriptions for the lay person.

Alignments illustrated within FIG. 1C provide descriptive positions consistent with full storage conditions of the supporting applications. Relative descriptions illustrate basic movements and operative principles within the guide assembly 20A, rack assembly 30A, drawer assembly 40A, and container assembly 50A. The guide assembly 20A supports illustrated drawer element 40 as previously described. M1, M2, M3, M4, M5, M6 illustrate basic descriptive positions of an center of mass initially established about midpoint M0 generated along coupler curve C9 with corresponding coupler link, fixed link instant centers I1, I2, I3, I4, I5, I6. Lines of alignment A1, A2, A3, A4, A5, A6 between center of mass positions and corresponding coupler link, fixed link assembly instant centers describes anterior, vertical and posterior reflexly poised assembly operations.

Alignments illustrated within FIG. 1D, provide basic descriptive positions consistent with partially full storage conditions of the supporting applications. Relative descriptions illustrate basic movements and operative principles within the linkage apparatus assembly 20A, drawer assembly 40A, and container assembly 50A with partial movements. C1, C2, C3, C4, C5, C6 illustrate basic descriptive positions of the center of mass initially established above fixed pivot 13 with corresponding coupler link, fixed link instant centers D1, D2, D3, D4, D5, D6. Alignments B1, B2, B3, B4, B5, B6 describes anterior, vertical and posterior reflexly poised assembly operations.

Relative descriptions comprise the following basic positions graphically illustrating reflexly poised alignment inclinations in anterior, vertical and posterior directions:

a. M1, C1 represents the position based on the vertical position of anterior link 11 with the corresponding instant center I1, D1 beyond the lower page limits in alignment A1, B1 reflexly inclined in the posterior direction.

b. M2, C2 represents the position based on the vertical alignment A2, B2 position of M2, C2 and the corresponding instant center I2, D2 defining a transfer position vertically poised between horizontal and concentric movement positions.

c. M3, C3 represents the position based on a 45 degree internal inclination to vertical of posterior link 12 with a corresponding instant center I3, D3 in alignment A3, B3 reflexly inclined in the anterior direction.

d. M4, C4 represents the position based on the dead center linkage position with corresponding instant center I4, D4 coincident with fixed pivot 13 hovering in the substantially vertical alignment A4, B4.

e. M5, C5 represents the position based on the vertical inclination of posterior link 12 with corresponding instant center I5, D5 beyond the upper page limits in alignment A5, B5 reflexly inclined in the posterior direction.

f. M6 represents a position based on a cradled vertical alignment A6 with corresponding upper instant center I6 vertically poised in the cradled position with C6 best providing a position within the horizontal range of the square P2, FIG. 1A, and, whereby these alignments provide foundations for describing the interdependent technical features within various proportional linkage assemblies. Rectangle P8 FIG. 1A extended between parallel assemblies defines a basic volume and boundry of storage operations.

The closed position of shelf 30, drawer 40 combines initial kinematic description coincident with alignment position A1, B1. Initial external rotational movement of parallel right and left anterior columns enables the rotational force of gravity to assist parallel transmission of shelf 30, drawer 40, container 50 over parallel right and left anterior pivotal columns support center. Movement of proportional tensile parallel right and left posterior hangers 32, 42 within the internal span of the support pivots enables internal pendulum forces of gravity to consistantly limit external rotation of parallel right and left anterior column 31, 41 and promotes closure of shelf element limited by parallel right and left support plates 3EP, vertical standard 47 in alignment A1, B1 position.

The shelf element 30, drawer 40, container 50 in alignment A2, B2 provides a vertically elevated position of instability and transfer between horizontal and concentric movement positions. Enguagement forces bridging alignments A2, B2 provide a predictable transfer position assisting ergonomic control of the shelf 30, drawer 40, container 50 within poised assembly operations. Anterior lifting of the handle 4E positioned proximal to an axis of parallel upper anterior column pivots provides substantial horizontal movement of drawer 40, container 50 in relation to substantially rotational handle movement. Support of asymmetrical center of mass loads within an shelf 30, drawer 40, container 50 defines varied vertical alignment transfer positions between substantially horizontal and concentric movements. Similar transfer operations occur with elective supported elements.

The shelf 30, drawer 40, container 50 in alignment A3, B3 provides 45 degree inclination of posterior support hangers 32, 42 imparting an elevating stop motion within assembly operations. Positions of the posterior hanger above the 45 degree inclination provides elevated start motions promoting parallel movement of shelf 30, drawer 40, container 50 reducing the potential of independent movement on opposing sides of parallel assemblies.

The shelf 30, drawer 40, container 50 in alignment A4, B4 provides substantially balanced concentric movement and anterior inclination of shelf 30, drawer 40, container 50. Proportional inclination of shelf 30, drawer 40, container 50 provides visibility and accessability of stored materials. Initial closing enguagement of the assembly lifts the anterior portion of the shelf 30, drawer 40, container 50 is assisted beyond transfer alignment A2, B2 by the rotational lowering movement of inclined posterior link 32, 42. The mass of storage supplies provide varied operations about the position of the combined center of mass. Estimated unbalanced loads of supplies in anterior containment provide a basis for posterior materials construction balancing the accessable concentration of various supplies. Balanced positioning of supplies substantially divides anterior and posterior support. Counterbalancing weights CW fastened about posterior regions or posterior distributions of supplies balance estimated concentrated of mass within the anterior containment regions are best provided in relation to the alignment A4, B4. Anterior movements beyond the basic concentric movement position are substantially limited by the extreme right position of the linkage assembly. Movement beyond alignment A4, B4 provides elevation of the supported element rotated substantially about the extreme right coupler link pivot. Assymetrical anterior loads are substantially confined within the concentric movement and extreme right assembly positions.

The drawer 40 in alignment A5, B5 provides parallel assembly movement converted through true parallel of the column and hanger assembly positions. Movement between A4 and A5 alignments enguages suspended movement below upper linkage instant centers. External posterior hanger movement combines with internal anterior column movement providing substantially stable horizontal cradling movement beyond anterior counterpoised inclination positions. Anterior columns and posterior hangers provide posterior movement between M4, C4 and M5, C5 positions. Enguagement forces bridging M4, C4 and M5, C5 positions provide substantially posterior horizontal movement between cradled positions and vertical anterior column positions.

The drawer 40 in alignment A6 provides substantially horizontal assembly movement of the center of mass M6 vertically below instant center I6 providing cradled stability within the fixed pivots. Drawer alignment B6 provides substantially horizontal movement of the center of mass reflexly poised in the posterior direction. Enguagement forces bridging alignment position A6, B6 enguages substantially cradled horizontal assembly movement supporting the drawer 40 and supplies. Proportional anterior column linkage element 21, hanger assemblies 41 inclination substantially promotes closure of drawer 40 about the bracket 47 restriction. Full drawer positions corresponding with assembly alignment position A6 provides a vertically poised position of a center of mass position below instant center I6. Substantially horizontal movement positions balance posterior assembly positions below upper instant center positions in poised vertical alignment A6 position. The C6 position is reflexly poised in the posterior direction within the bounds of the proportional constructive square P2.

Constructions about center of mass positions apart from the basic midpoint originated positions are best limited between positions below the midpoint and above the anterior fixed pivots. Various supplies accessable in open substantially horizontal positions of coupler link 10 provide various center of mass positions. Lower center of mass portion comprise displacement arms below substantially horizontal coupler link 10 positions. Inclination of the displacement arm provides a reduction of horizontal displacement of lower center of mass in relation to basic midpoint center of mass displacements. Lower centers of mass constructions provide operations inside the range of basic balance horizontal operations. Higher center of mass positions contain displacement arms above substantially horizontal coupler link 10 positions. Inclination of the higher displacement arm provides a increase of horizontal displacement in relation to basic midpoint center of mass displacements. Higher centers of mass constructions provide operations beyond the range of initial balanced inclination operations. Higher centers of mass constructions provide similar but less optimal operations. Constructions surrounding basic midpoint center of mass positions to one skilled in the art enable wide and varied counterbalanced inclination of supported elements in many applications.

Description/Alternate Operation of Proportional Linkage

Alternate proportional link dimensions which provide for the transfer of counterpoised elements between crosslinked and dead center positions of the proportional linkage employ the intended use of this invention. Principle descriptions enable reference to varied proportional links dimensions and center of mass applications exemplified by the described operations. Providing adjustments to the basic lengths of the described links and span proportions will provide assembies which balance asymmetrical elements or provide various inclinations of elective elements.

Figure 1E:
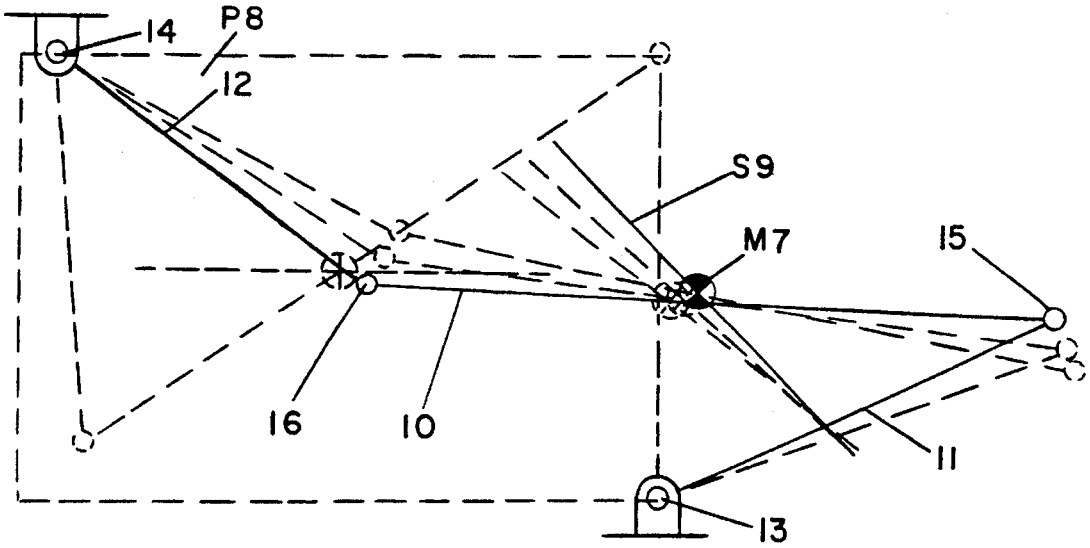
FIG. 1E is a kinematic view of alternate fixed link positioning of the established linkage in the dead center position.
Figure 1F:
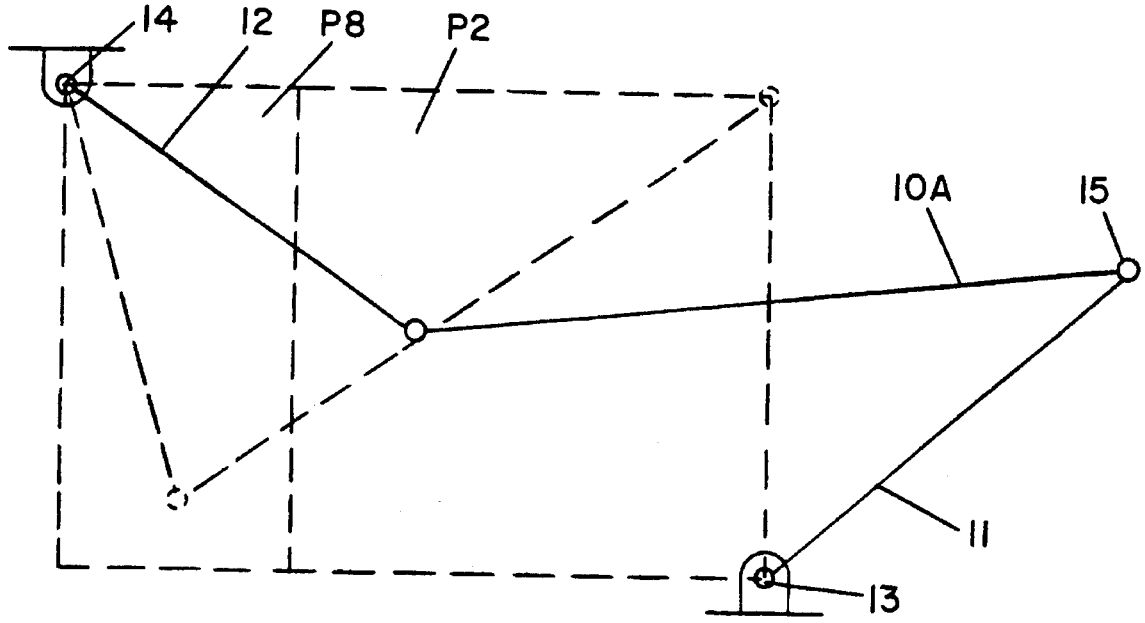
FIG. 1F is a kinematic view of alternate coupler link positioning the established linkage in the dead center position.
Figure 3B:
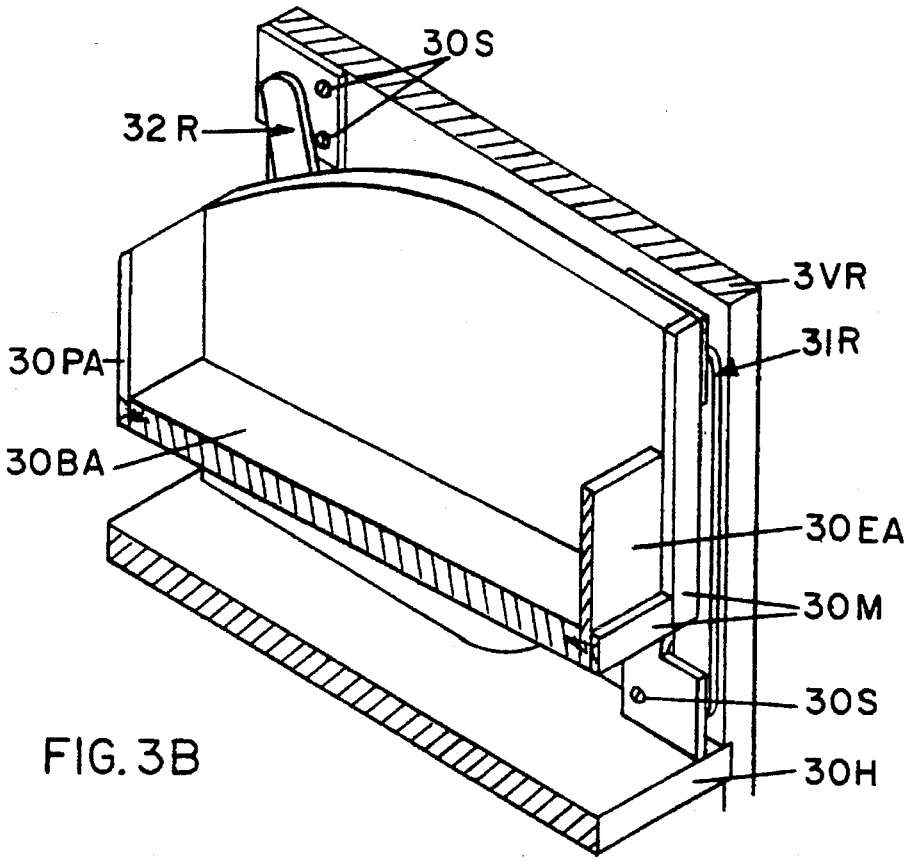
FIG. 3B is a sectional isometric view of alternate shelf taken along 4—4 in FIG. 3.

Referring to FIG. 1E the alternate positioning of the shelf element 30 is supported by the anterior column assemblies 41R, 41L through right and left anterior bearing holes 4AB and posterior hanger assemblies 42R, 42L through bearing holes 4PA of the brackets 47R, 47L. Said support of shelf element 30 provides alternate inclination about the horizontal span P5 between the fixed pivots repositioning the shelf element 30 constructed about the basic proportional linkage. This support arrangement of shelf 30 establishes the center of mass position M7 substantially vertical and slightly external of the rectangle P8. The external position of shelf element 30 center of mass hovers the shelf element 30 between the extreme right dead center position of posterior link 12 and coupler link 10 and dead center positions of the posterior link 12 and fixed link 17. Alternate balancing positions between extreme right and initial dead center positions provide substantial stability. The inclination of horizontal line S9 provides a 45 degree angle of inclination of shelf 30 approaching the extreme right position of anterior display. Coordination of assymetrical mass in relation to movements between initial movement positions enable proportional supporting links adjustments confining various distribution of mass within the range of movement of various proportional linkage support assemblies. Variations of asymmetrical positions of an center of mass or varied initial inclinations can be established in relation to basic vertical alignment transfer positions A2, B2, FIG. 1C, 1D.

The incorporation of existing latching assemblies could stabilize open positions in conjunction with simple coupler curve proportional linkages. Initial alignments provides a basis for coordinating combined descriptions of kinematic and gravitational principles and operations of proportional linkage assemblies. Prior art formula in conjunction with the alignment positions provides the basis for applied variations of basic dimensions within assymetrical proportional linkage support assemblies. As will be obvious to one skilled in the art, further illustrations and variations of kinematic descriptions can be made without departing from the spirit and scope of proportional linkage support assembly applications.

Summary, Ramifications, and Scope

Thus, arranging the counterbalancing support of elements about the inclinations of parallel proportional linkages provides ease of opening and closing operations. The inclination of supported elements with stored supplies substantially divides enguagement requirements for the ease of repeated use. Linkage inclination restrained about fixed pivot means fosters parallel assembly motion. Applications limited to anterior counterpoised inclinations provides the most simple operation with little effort required for access to supplies. Movement from the cradled movement position through anterior counterpoised inclination to concentric movement positions provide access without the cantilevered force restrictions of existing support systems. Thus, the application of proportional linkage constructions within moveable support assemblies provides an economical, ergonomically advantageous, highly reliable movable support function which can be applied in most retractable assemblies. While the invention has been described in conjunction with specific applications, these should not be construed as limitations on the scope of the invention, but rather to exemplify basic references for various applications. Many other variations are possible within similar proportional linkages providing balancing inclination functions. For example, a recycling storage bin, refrigerator container, automobile glove box, chest of drawers, kitchen reference cook book holder, devices for the disable and an myriad of storage and access functions invite proportional support linkage assembly uses. Accordingly the scope of the invention should not be determined by the illustrated applications, but by the appended claims and their legal equivalents.

I claim:

1. A apparatus assembly comprising parallel right and left support linkage apparatuses providing fastening means with an elective coupler link element and parallel vertical standards, with the right and left linkage apparatuses respectfully comprising;

a. a rigid proportional fixed link element having fastening means with right and left vertical standards respectfully and having a lower fixed pivotal end fastening means with b. a lower pivotal end of a rigid anterior column link element having upper pivotal end fastening means with c. a anterior pivotal end fastening means of a rigid coupler link element having right and left fastening means respectfully with an elective element and having posterior pivotal end fastening means with d. a lower pivotal end fastening means of a rigid posterior hanger link element having upper pivotal end fastening means with a upper fixed pivotal end of the respective fixed link element, and whereby the plurality of right and left linkage apparatuses comprise basic proportional length dimensions and positions of the fixed linkage elements established in relation to the vertical position of the basic anterior column link elements, with the basic proportional link length dimensions comprising, 1. the anterior column link of approximately 1.0 unit length with 2. the coupler link elements of approximately 1.6 unit length with 3. the posterior link element of approximately 0.89 unit length with 4. the fixed link element of 1.79 unit length, and, whereby, the upper posterior fixed pivotal end is positioned along the horizontal extended from the upper vertical anterior column link pivotal end with the fixed link elements fastened to the vertical standards respectfully, and, whereby, the elective coupler link element has a center of mass which is positioned along an axis between the parallel linkage apparatuses and along the coupler link element center of mass coupler curve whereby the coupler link element center of mass is;

a. aligned about the axis of the fixed link elements midpoints in the crosslinked position which has vertical anterior column link elements, and b. aligned about the vertical of the anterior fixed pivotal end axis and between the upper and lower fixed pivotal end in the posterior hanger and fixed link elements dead center position, and whereby, the range of coupler link inclination between the posterior and fixed link elements dead center position and the cross linked position having vertical anterior column link elements comprises a transfer position of restrained coupler link element inclination and balance between the substantially horizontal and concentric movement positions of the support linkage apparatus assembly, and whereby the balance of the coupler link supported element comprises the alignment about the vertical of the coupler link element center of mass with a coupler link instant center along an axis of parallel linkage apparatus instant centers.

2. A assembly according to claim 1 providing shelf storage and display of paper, magazines and substantially planar materials comprising, in combination;

a. a frame assembly having a plurality of laterally stabilized horizontal and vertical standards having fixed link fastening means with and supporting in combination;

b. plural parallel right and left support linkage apparatuses having coupler link fastening means with;

c. a coupler link shelf element comprising in combination;

1. a base element, and
2. plural parallel coupler link side panels fastened to opposite sides of said base element having fastening means with parallel right and left linkage apparatuses and,
3. a anterior end panel fastened with said base element, and,
4. a posterior end panel fastened with said base element, and, whereby the shelf element is constructed about a center of mass positioned about the midpoint axis between the fixed pivots in the linkage position having the vertical anterior columns, and whereby the shelf element provides a means of restraint to posterior movement about the vertical columns position.

3. A assembly according to claim 2 whereby the rigid fixed and coupler link elements of the right and left linkage apparatuses are provided for within the display rack assembly vertical standards and coupler link element side panels whereby the column and hanger link elements have adjustable fastening means which provide adjustable coupler link and fixed link length fastening about the vertical standards and coupler link element side panels comprising, in combination;

a. a frame assembly having a plurality of laterally stabilized horizontal and vertical standards providing adjustable fixed pivots fastening means supporting in combination;

b. plural parallel right and left anterior pivotal column assemblies comprising;

1. lower adjustable fixed pivots fastening means with said vertical standards and having pivotal fastening means with
2. the lower pivotal end of proportional dimension anterior columns and having upper pivotal end fastening means with
3. the anterior end of adjustable coupler link fastening means with the coupler link shelf element, in combination with c. plural parallel right and left posterior pivotal hanger assemblies comprising;

1. upper adjustable fixed pivot fastening means with said vertical standards and having pivotal fastening means with
2. the upper end of proportional dimension posterior hangers and having lower pivotal end fastening means with
3. the posterior pivotal end of adjustable coupler link fastening means with the coupler link shelf elements, and whereby the hanger and column assemblies support d. a coupler link shelf element comprising in combination;

1. a base element, and
2. plural parallel coupler link side panels fastened to opposite sides of said base element having adjustable fastening means with parallel pivotal column and hanger assemblies, and,
3. a anterior end panel fastened with said base element, and,
4. a posterior end panel fastened with said base element.

4. A assembly according to claim 3 whereby the basic proportional fixed links length dimensions are adjusted along the horizontal whereby the length between the posterior fixed pivots and the upper pivotal end of the vertical anterior column link elements is 1.414 unit length.

5. A assembly according to claim 1 providing storage of a coupler link drawer and supplies of three dimensional materials comprising in combination;

a. plural parallel right and left vertical standards providing fixed link fastening means and supporting in combination, b. plural parallel right and left support linkage apparatuses having coupler link fastening means with;

c. a coupler link drawer comprising in combination, 1. a base element, and,
2. plural parallel coupler link drawer side panels fastened to opposite sides of said base element providing fastening means with the parallel linkage apparatuses and,
3. a anterior end panel, and,
4. a posterior end panel, whereby the drawer is constructed about a center of mass positioned about the midpoint axis between the fixed pivots in the linkage position having vertical anterior columns, and whereby the drawer assembly provides a means of restraint to movement between the vertical columns position and the cradled position and whereby the cradled position comprises a vertical alignment along the axis of the drawer center of mass between the fixed pivots with a linkage instant center which is along an axis between the parallel linkages and above the fixed pivots.

6. A assembly according to claim 5 whereby the rigid fixed and coupler link elements of the right and left linkage apparatuses are provided for within the drawer assembly vertival standards and drawer side panels whereby the column and hanger link elements have adjustable fastening means which provide adjustable coupler link and fixed link length fastening about the vertical standards and coupler link drawer side panels comprising in combination;

a. plural parallel right and left vertical standards providing adjustable upper fixed pivots fastening means supporting in combination, b. plural parallel right and left anterior pivotal column assemblies comprising in combination;

1. lower fixed pivots fastening means with the vertical standards and having pivotal fastening means with
2. the lower pivotal end of proportional dimension anterior columns and having upper pivotal end adjustable fastening means with
3. the coupler link drawer side panels in combination with c. plural parallel right and left posterior pivotal hanger assemblies comprising in combination;

1. upper adjustable fixed pivot fastening means with said vertical standards and having pivotal fastening means with
2. the upper pivotal end of proportional dimension posterior hangers and having lower pivotal end adjustable fastening means with
3. the coupler link drawer side panels, and whereby said column and hanger assemblies support d. a coupler link drawer comprising in combination,
1. a base element, and,
2. plural parallel coupler link drawer side panels providing coupler link fastening means with parallel pivotal column and hanger assemblies, and,
3. a anterior end panel, and,
4. a posterior end panel whereby the drawer assembly provides a means of restraint to movement between the vertical columns position and the cradled position and whereby the cradled position has a vertical alignment along the axis of the drawer center of mass between the fixed pivots with a linkage instant center which is along an axis between the parallel linkages and above the fixed pivots.

7. A assembly according to claim 6 whereby the basic proportional fixed links length dimensions are adjusted along the horizontal whereby the length between the posterior fixed pivots and the upper pivotal end of the vertical anterior column link elements is 1.414 unit length.

8. A assembly according to claim 1 providing storage of a coupler link container and three dimensional materials comprising, in combination;

a. plural parallel right and left vertical standards providing fixed links fastening means supporting in combination, b. plural parallel right and left support linkage apparatuses having coupler link element fastening means with, c. a coupler link container comprising in combination,
1. a bottom panel, and
2. right and left parallel coupler link container side panels providing coupler link fastening means with parallel pivotal column and hanger assemblies, and
3. a posterior end panel, and
4. a anterior end panel, whereby the shelf element is constructed about a center of mass positioned about the midpoint axis between the fixed pivots in the linkage position having the vertical anterior columns, and whereby the shelf element is constructed about a center of mass positioned about the midpoint axis between the fixed pivots in the linkage position having the vertical anterior columns, and whereby the shelf element provides a means of restraint to posterior movement about the vertical columns position.

9. A assembly according to claim 8 whereby the rigid fixed and coupler link elements of the right and left linkage apparatuses are provided for within the container assembly vertical standards and container side panels respectfully whereby the column and hanger link elements have adjustable fastening means which provide adjustable fixed link and coupler link length dimensions fastening about the vertical standards and coupler link side panels comprising in combination;

a. plural parallel right and left vertical standards providing adjustable fixed links fastening means supporting in combination, b. plural parallel right and left anterior pivotal column assemblies comprising in combination;
1. lower fixed pivots fastening means with the vertical standards and having pivotal fastening means with
2. the lower pivotal end of proportional dimension anterior columns and having upper pivotal end fastening means with
3. the anterior pivotal end of proportional dimension coupler links and having fastening means with the coupler link container side panels respectfully, and, c. plural parallel right and left posterior pivotal hanger assemblies comprising in combination;
1. upper fixed pivots fastening means with the vertical standards and having pivotal fastening means with
2. the upper pivotal end of proportional pivotal hangers and having lower pivotal end fastening means with
3. the posterior end of proportional dimension coupler links and having fastening means with the coupler link container side panels respectfully, and, whereby the proportional columns and hanger assemblies support d. a coupler link container comprising in combination,
1. a bottom panel, and
2. right and left parallel coupler link container side panels providing coupler link fastening means with parallel pivotal column and hanger assemblies, and
3. a posterior end panel, and
4. a anterior end panel.

10. A assembly according to claim 9 which comprises adjusted upper posterior linkage fixed pivot fastening positions and thereby adjusted fixed link dimensions established through reducing the proportional horizontal dimension of 1.48 unit between the upper fixed pivots and the upper vertical anterior link pivot to 1.41 unit, 1/20 one twentieth of the dimension between the upper posterior fixed pivot and the upper vertical anterior link pivot, and thereby providing a horizontal adjustment of the basic fixed links length proportions and fastening positions.

* * * * *